US012297025B2

(12) United States Patent
DeRaedt et al.

(10) Patent No.: US 12,297,025 B2
(45) Date of Patent: May 13, 2025

(54) BOX FOR RECEIPT OF BAGS CONTAINING LIQUID

(71) Applicant: Bar Evolution LLC, Henderson, NV (US)

(72) Inventors: Peter DeRaedt, Henderson, NV (US); Bernd Witzany, Munich (DE); Felix Ballendat, Munich (DE)

(73) Assignee: Bar Evolution LLC (ES)

( * ) Notice: Subject to any disclaimer, the term of this patent is extended or adjusted under 35 U.S.C. 154(b) by 110 days.

(21) Appl. No.: 18/188,581

(22) Filed: Mar. 23, 2023

(65) Prior Publication Data

US 2024/0034536 A1 Feb. 1, 2024

Related U.S. Application Data

(60) Provisional application No. 63/392,566, filed on Jul. 27, 2022.

(51) Int. Cl.

| | |
|---|---|
| ***B65D 77/06*** | (2006.01) |
| ***B65D 5/498*** | (2006.01) |
| ***B65D 25/04*** | (2006.01) |

(52) U.S. Cl.

CPC ..... *B65D 77/062* (2013.01); *B65D 5/48048* (2013.01); *B65D 25/04* (2013.01)

(58) Field of Classification Search

CPC .... B65D 5/4802; B65D 5/48; B65D 5/48002; B65D 5/48048; B65D 25/04; B65D 77/062; B65D 77/065; B65D 77/067

(Continued)

(56) References Cited

U.S. PATENT DOCUMENTS 2,864,534 A 12/1958 Wrenn
2,926,781 A * 3/1960 Dickhens ..... B65D 71/16 229/162.6

(Continued)

FOREIGN PATENT DOCUMENTS

EP 1295844 A1 3/2003
EP 2236434 A1 * 10/2010 ..... B65D 77/0426

(Continued)

OTHER PUBLICATIONS

Webpage: http://www.bevmo.com/fireball-whisky-firebox-2-1-75-2-pk-1-751tr-.html; downloaded from internet on Oct. 4, 2016; 2 pages.

*Primary Examiner* — Nathan J Newhouse
*Assistant Examiner* — Phillip D Schmidt
(74) *Attorney, Agent, or Firm* — Endurance Law Group PLC; James R. Yee

(57) ABSTRACT

A connector assembly controllably couples a box having a plurality of containers containing a liquid, is provided. Each container has a fitment. The connector assembly includes a housing, a valve assembly, actuator and a locking plate. The valve assembly includes a plurality of fitment receptacles. The actuator is rotatably coupled to the housing and is movable between an open position, a closed position and an engaged position. The locking plate assembly includes a plurality of opening corresponding to each fitment. The opening has a first diameter when the actuator is in the open position. The first diameter of the opening is configured to allow entry of the fitments into the opening. Movement of the actuator from the open position to the closed position closes the opening to a second diameter.

14 Claims, 18 Drawing Sheets

(58) Field of Classification Search
USPC ..... 229/120.32, 177.27, 177.35, 229/120.14–120.16
See application file for complete search history.

(56) References Cited

U.S. PATENT DOCUMENTS

| | | | | |
|---|---|---|---|---|
| 3,759,422 | A | 9/1973 | Matheney | |
| 3,904,079 | A | 9/1975 | Kross | |
| 4,496,081 | A | 1/1985 | Farrey | |
| 4,687,120 | A | 8/1987 | McMillin | |
| 4,898,303 | A | 2/1990 | Large et al. | |
| 4,913,316 | A | 4/1990 | Richter | |
| 4,927,042 | A * | 5/1990 | Ring | B65D 21/0237 222/465.1 |
| 5,186,359 | A * | 2/1993 | Brown | B65D 77/067 222/93 |
| 5,344,051 | A | 9/1994 | Brown | |
| 5,750,216 | A | 5/1998 | Horino et al. | |
| 6,202,878 | B1 | 3/2001 | Cook | |
| 7,197,377 | B2 | 3/2007 | Knepler | |
| 7,621,439 | B2 * | 11/2009 | McClure | B65D 5/5035 206/499 |
| 7,918,368 | B2 | 4/2011 | Crisp et al. | |
| 8,340,815 | B2 | 12/2012 | Peters et al. | |
| 8,442,674 | B2 | 5/2013 | Tilton et al. | |
| 8,515,574 | B2 | 8/2013 | Studor et al. | |
| 8,565,916 | B2 | 10/2013 | Zhang et al. | |
| 8,676,376 | B2 | 3/2014 | Quartarone et al. | |
| 8,701,933 | B2 * | 4/2014 | Thomason | A47K 5/13 141/2 |
| 8,739,840 | B2 | 6/2014 | Mattos et al. | |
| 8,894,599 | B2 | 11/2014 | Kataria | |
| 8,910,856 | B2 * | 12/2014 | Sumpmann | B65D 5/542 206/746 |
| 8,952,784 | B2 | 2/2015 | Katerberg et al. | |
| 9,056,759 | B2 | 6/2015 | Hourmand et al. | |
| D781,632 | S | 3/2017 | Kaytas et al. | |
| 11,053,113 | B2 | 7/2021 | Tomforde et al. | |
| 2003/0201280 | A1 * | 10/2003 | Geshay | B65D 77/067 222/1 |
| 2006/0049240 | A1 * | 3/2006 | LeBras | B65D 71/24 229/162.6 |
| 2006/0097005 | A1 * | 5/2006 | Hill | B65D 5/46096 222/105 |
| 2008/0314927 | A1 * | 12/2008 | Martin | B67D 3/0067 222/129 |
| 2009/0069932 | A1 | 3/2009 | Rudick | |
| 2009/0277516 | A1 | 11/2009 | Winkler et al. | |
| 2012/0035761 | A1 | 2/2012 | Tilton et al. | |
| 2013/0119066 | A1 * | 5/2013 | Hanna | B65D 5/6661 229/148 |
| 2014/0107835 | A1 | 4/2014 | Biasi et al. | |
| 2014/0109526 | A1 | 4/2014 | Taylor et al. | |
| 2019/0071298 | A1 | 3/2019 | Tomforde et al. | |
| 2021/0087046 | A1 * | 3/2021 | Chaloupka | B67D 3/04 |

FOREIGN PATENT DOCUMENTS

| | | | | |
|---|---|---|---|---|
| KR | 20140005970 | U * | 11/2014 | |
| WO | WO-2011014924 | A1 * | 2/2011 | B65D 5/48014 |

* cited by examiner

BOX FOR RECEIPT OF BAGS CONTAINING LIQUID

CROSS REFERENCE TO RELATED APPLICATIONS

This application claims priority to U.S. Provisional Patent Application 63/392,566 filed on Jul. 27, 2022, the entire disclosure of which is hereby incorporated by reference and relied upon.

BACKGROUND OF THE INVENTION

Field of the Invention

The present disclosure relates generally to beverage dispensing solutions, and more specifically, to a package or box for receiving a plurality of containers containing a liquid for use with a beverage dispensing solutions.

Background of the Invention

Regulations vary from country to country on how distilled spirits can be distributed, not only the volume but also packaging, labeling, filling, etc. In the United States, the Department of Treasury Alcohol & Tobacco Tax & Trade Bureau (TTB) regulates the bottle sizes for distilled spirits. Further, the Internal Revenue Code of 1986 authorizes regulations on the kind and size of containers for distilled spirits. According to the TTB, the purpose of the regulations establishing uniform standards of fill for alcoholic beverages is "to prevent a proliferation of bottle sizes and shapes which would inevitably result in consumer confusion and deception with regard to the quantity and net contents of the alcohol beverage package." In addition, the "uniformity in bottle sizes required by these standards also facilitates the proper calculation of Federal excise tax." A key issue related to these concepts is the potential loss of water and the resulting increase in alcohol concentration or "proof" which may be affected by the packaging.

The maximum volume of packaging of spirits may be limited in some jurisdictions. For example, in the United States, the maximum volume of packaging in which spirits can be shipped or distributed is currently 1.8 liters. This limitation has a significant impact for places where spirits are distributed or consumed in large quantities such as clubs, large events, bars, conferences, etc.

The current way to address this regulatory restriction is to create pump rooms filled with racks in which bottles are turned upside down and collectors channel the liquid through tubes to pumps and ultimately, to the dispensing device(s). This multiplies the capacity of a specific distilled spirit by the number of bottles used. However, this method requires significant real estate to support the bars in the property. It further has an impact on labor, space, weight, time and also the disposal process that generates a lot of waste. As a result, this solution creates significant inefficiencies.

The present disclosure is aimed at solving one or more of the problems identified above.

BRIEF SUMMARY OF THE INVENTION

In a first aspect of the present invention, a box for receiving a plurality of containers containing a liquid is provided. Each container has a fitment. The box includes a top panel, a bottom panel, first, second, third and fourth side panels and an inner support panel. The top panel includes a plurality of apertures. The top, bottom, first, second, third and fourth side panels are connected together defining an inner volume to receive the plurality of containers. Each aperture of the top panel is associated with the fitment of a respective container and is configured to allow the respective fitment to be positioned outside of the inner volume. The inner support panel is located within the inner volume to separate the inner volume into a plurality of compartments. Each compartment is configured to receive one of the plurality of containers.

In a second aspect of the present invention, a package for receiving a plurality of containers containing a liquid is provided. Each container has a fitment. The package includes an outer box and an inner box. The inner box includes a top panel, a bottom panel, first, second, third and fourth side panels and an inner support panel. The top panel includes a plurality of apertures. The top, bottom, first, second, third and fourth side panels are connected together defining an inner volume to receive the plurality of containers. Each aperture of the top panel is associated with the fitment of a respective container and is configured to allow the respective fitment to be positioned outside of the inner volume. The inner support panel is located within the inner volume to separate the inner volume into a plurality of compartments. Each compartment is configured to receive one of the plurality of containers.

In a third aspect of the present invention, a blank for a box is provided. The box is configured for receiving a plurality of containers containing a liquid. Each container has a fitment. The blank includes a top panel, a bottom panel and first, second, third and fourth side panels. The top panel includes a plurality of apertures. The first side panel is hingedly coupled to the top panel. The bottom panel is hingedly coupled to the first side panel. The top panel and the bottom panel are located at opposite sides of the first side panel. The second side panel is hingedly coupled to the bottom panel. The first and second panels are located on opposite sides of the bottom panel. The third side panel includes at least one third side panel flap hingedly coupled to an adjacent side of one of the first and second side panels. The fourth side panel includes at least one fourth side panel flap hingedly coupled to an adjacent side of another one of the first and second side panels. When assembled, the top, bottom, first, second, third and fourth panels define an inner volume to receive the plurality of containers. Each aperture of the top panel is associated with the fitment of a respective container and is configured to allow the respective fitment to be positioned outside of the inner volume. The first side panel includes at least one first cutout. The second side panel includes at least one second cutout. The at least one first cutout and the at least one second cutout form an inner support panel.

In a fourth aspect of the present invention, a method of assembling an inner box containing a plurality of containers containing a liquid is provided. Each container has a fitment. The method includes the step of providing an inner box. The inner box includes a top panel, a bottom panel and first, second, third and fourth side panels defining an inner volume. The top panel includes a plurality of apertures. One of the side panels being in an open configuration. The method further includes the steps of inserting one of the containers into the inner volume, installing an inner support panel, inserting another one of the containers above the inner support panel, repeating steps (c) and (d) until the inner box is full, and closing the inner box.

BRIEF DESCRIPTION OF THE SEVERAL VIEWS OF THE DRAWINGS

Advantages of the present disclosure will be readily appreciated, as the same becomes better understood by reference to the following detailed description, when considered in connection with the accompanying drawings. Non-limiting and non-exhaustive embodiments of the present disclosure are described with reference to the following figures, wherein like numerals refer to like parts throughout the various views unless otherwise specified. These and other features and advantages of the present invention will become more readily appreciated when considered in connection with the following detailed description and appended drawings.

DETAILED DESCRIPTION OF THE INVENTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Reference throughout this specification to "one embodiment", "an embodiment", "one example" or "an example" means that a particular feature, structure or characteristic described in connection with the embodiment of example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

With reference to the drawings and in operation, the present invention relates to a multi-bag package or box 104 for use in a beverage system 100. As discussed in further detail below, a multi-bag connector assembly 110 is configured to controllably connect the beverage dispensing package or box 104 with the beverage system 100.

Figure 1:
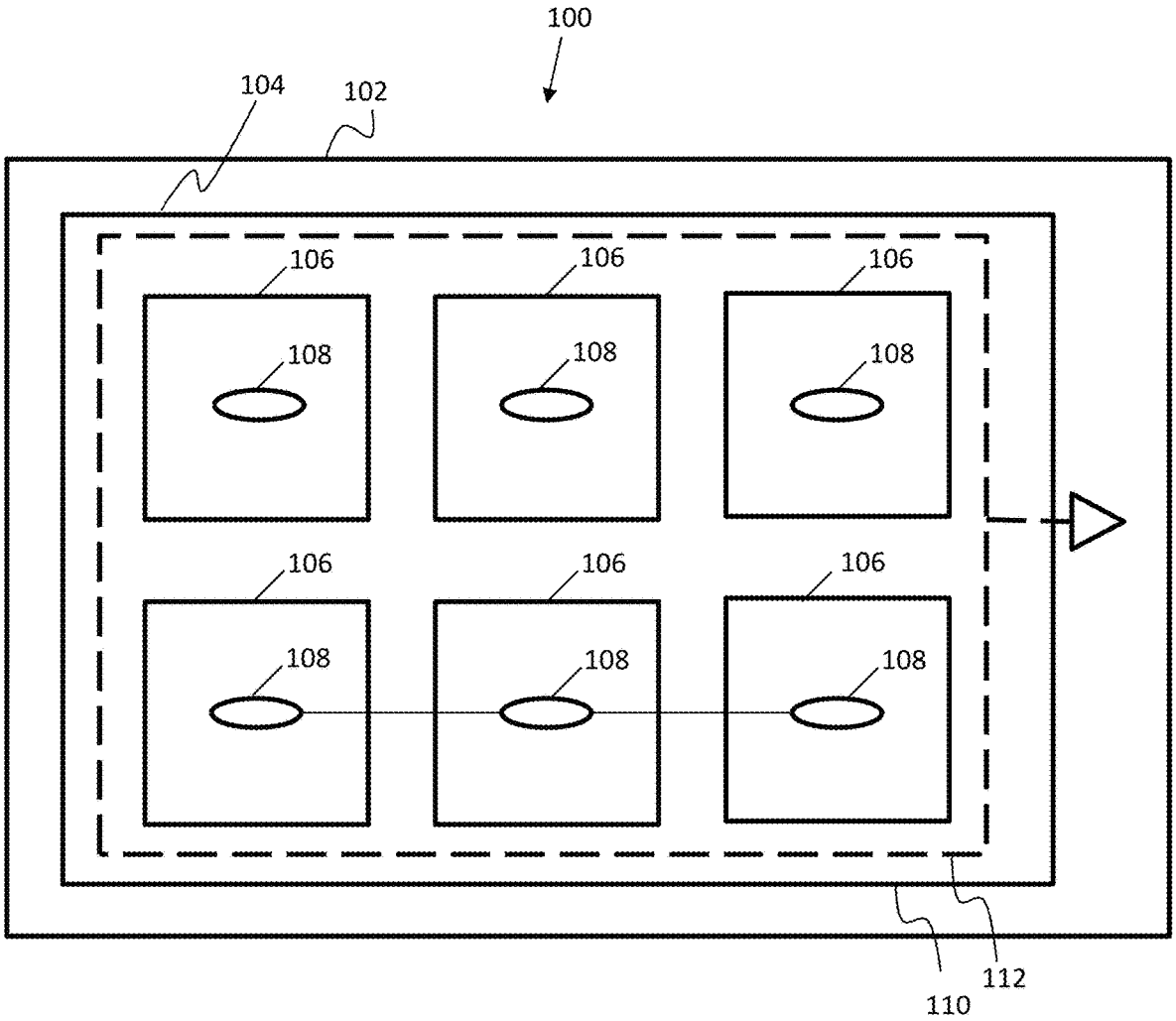
FIG. 1 is a block diagram of a beverage dispensing system that may be used to dispense alcoholic beverages.

With specific reference to FIG. 1, the present disclosure particularly describes exemplary beverage dispensing systems 100 and packages (e.g., boxes) 104 that may be used to dispense liquids or beverages. As used herein, the term beverage" refers to any beverage or liquid with or without alcoholic content that is meant for human consumption. FIG. 1 is a block diagram of an exemplary beverage dispensing system 100 that may be used to dispense liquids, such as alcoholic beverages. In one embodiment, the beverage dispensing system 100 is a bartender station (or is included therein) at a bar. Alternatively, the beverage dispensing system 100 may be used with, or incorporated within, any suitable location such as a kitchen, a bar, a reception area, or may be a portable station that may be used to serve alcoholic beverages in any suitable location.

Each box 104 may include one or more dividers (see below) that form two or more compartments within each box 104. Each compartment is designed to hold an inner container (e.g., a bag) 106 which holds an alcoholic beverage. Each bag 106 includes a fitment 108 that is attached to the bag 106 for dispensing the alcoholic beverage. Each fitment 108 is separated from each other fitment 108 so that the contents of each bag 106 do not mix or flow together until a connector assembly (see below) is attached. An alignment plate, or other suitable structure, may be used to align the fitments of the bags in preparation for attaching to the connector assembly 110.

In some embodiments, a separate alignment plate is utilized. In other embodiments, a separate alignment plate is not utilized. The box 104 may be composed primarily of cardboard with an integral structure that performs the function of the alignment plate. For instance, in one embodiment, the box 104 may include an inner box and an outer box. The inner box has a top surface with apertures for receiving a respective fitment for maintaining the correct spatial relationship there between.

As shown diagrammatically in FIG. 1, a connector assembly (or multi-bag connector or MBC) 110 is configured to receive the box 104. The connector assembly 110 includes a valve assembly 112 adapted to be coupled to the fitments of each bag within the box 104. The valve assembly 112 fluidly couples the bags 106, via each respective fitment 108, in the box 104 to the common outlet 112.

The embodiments described herein comply with the Department of Treasury Alcohol & Tobacco Tax & Trade Bureau (TTB) regulations in that the alcoholic beverages contained in the bags are shipped in a "divorced" state (i.e., the outlets of the bags are not connected together) so that each bag is a self-contained bag that may hold the maximum amount of an alcoholic beverage. The embodiments also enable significant efficiencies to be realized for distributors and end users of the alcoholic beverages. For example, larger quantities of alcoholic beverages may be shipped to a destination and may be efficiently and conveniently prepared for use as compared to prior art systems where individual bottles of alcoholic beverages are shipped. In one example, according to an embodiment described herein, a box may include four bags that each holds up to a maximum allowable volume, e.g., 1.8 liters of an alcoholic beverage. Accordingly, a single box, with 4 containers, may include 7.2 liters of an alcoholic beverage that is able to be quickly attached to a connector assembly for dispensing at an end user location. Other boxes may be used with other suitable numbers of bags to enable distributors to have a wide variety of options in the amount of alcoholic beverages to include within a box. For example, boxes with 6 or 8 bags (or any suitable number) may be used to provide 10.8 liters or 14.4 liters of alcoholic beverages (or any suitable amount) as desired. For example, in one embodiment, the bags may be arranged in two rows, each with a predetermined number of bags, e.g., 2. In other embodiments, each container contains a predetermined number of bags, e.g., 4 in a single row.

In one embodiment, the beverage dispensing system 100 includes a cabinet or housing 102 and a plurality of beverage dispensing packages 104 positioned within housing 102. Beverage dispensing system 100 may be placed in a bar, a kitchen, or in any other suitable location to enable a user to dispense alcoholic beverages from the system 100. For example, a bartender may use beverage dispensing system 100 to dispense alcoholic beverages from each of the beverage dispensing packages 104 during operation.

In one embodiment, each beverage dispensing package 104 is a box or other suitable container that includes a plurality of beverage dispensing bags, for example. Each bag is designed to hold 1.8 liters of alcoholic beverage as specified by the applicable regulations. For clarity of description, beverage dispensing packages 104 may be referred to herein as boxes 104, although it should be recognized that beverage dispensing packages 104 may be any suitable container other than a box. Similarly, for clarity of description, boxes 104 are described as including a plurality of beverage dispensing bags (or "bags") 106. However, it should be recognized that any suitable internal containers may be used instead of bags.

Figure 2A:
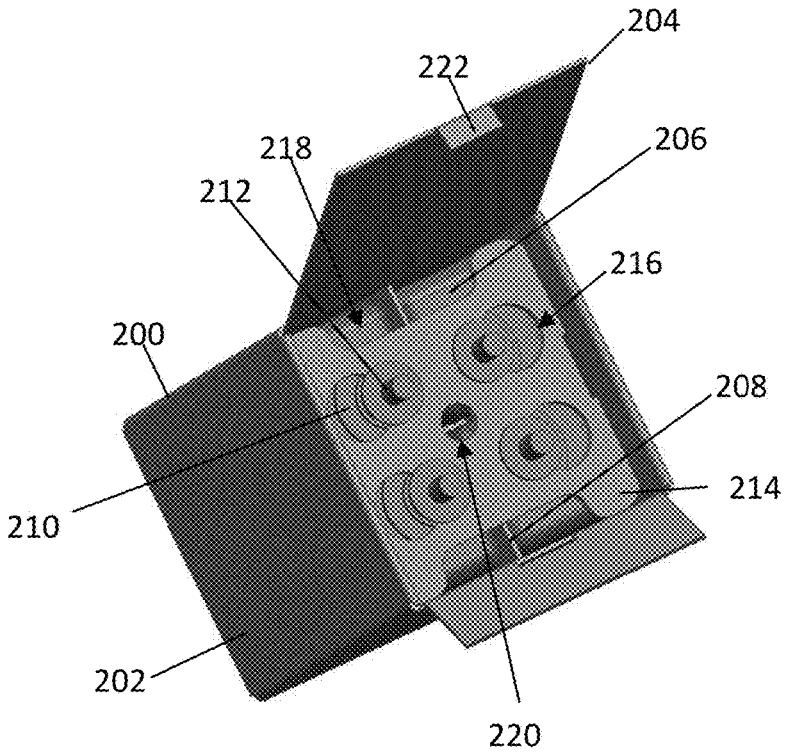
FIG. 2A is a perspective view of an exemplary beverage dispensing package that may be used with the beverage dispensing system shown in FIG. 1.

FIG. 2A is a perspective view of an exemplary beverage dispensing package 200, such as a box 200, that may be used with beverage dispensing system 100 (shown in FIG. 1). While the package 200 is described herein as a box, it should be recognized that any suitable package or container may be used.

In an exemplary embodiment, the box 200 is a cardboard box that includes sides 202 and a top cover 204. The top cover 204 is removable to expose or to cover a plurality of compartments (not shown in FIG. 2) that include a plurality of inner containers, such as beverage dispensing bags 206. The compartments are formed by one or more dividers 208 positioned within box 200.

In an exemplary embodiment, two dividers 208 are positioned within box 200 to form four substantially equally sized and shaped compartments. More specifically, in the exemplary embodiment, each compartment has a square-shaped cross-section that houses a respective bag 206 that also has a substantially square-shaped cross-section. Alternatively, any suitable number and shape of compartments and bags 206 may be used with box 200. In addition to creating compartments within box 200, dividers 208 provide stability and support to box 200.

Each bag 206 includes an outlet (not shown in FIG. 2) that enables liquid (e.g., an alcoholic beverage) to be dispensed from bag 206. A container fitment 210 or another suitable connector is securely fit onto an outlet 224 of each bag 206 to enable the outlet 224 of each bag 206 to be releasably coupled to a connector assembly 110. Accordingly, in the exemplary embodiment, each outlet 224 is initially separated from each other outlet 224 until the connector assembly 110 is attached to the fitments 210. In this manner, the outlets 224 of each bag 206 may be transported in a "divorced" manner (i.e., not in fluid communication with each other) to satisfy applicable governmental regulations and may then be connected together by a connector assembly 110 at the final destination to provide one common fluid dispensing line that dispenses the contents of each bag 206 through the common dispensing line.

In one embodiment, each fitment 210 may include a removable cap 212 that prevents the contents of each bag 206 from spilling or leaking out during transport. Caps 212 also may be included for health reasons, for example, to prevent contamination of fitments 210. In a more specific embodiment, each cap 212 may be glued or otherwise attached to top cover 204 of box 200 during shipping so that when a user opens top cover 204, each cap 212 will be automatically removed to expose the fitments of each bag 206. Alternatively, the caps 212 may be connected together by a string or another suitable connection to enable a user to quickly remove all caps 212 at the same time or in quick succession. In one embodiment, caps 212 may be used to visibly determine whether bags 206 or fitments 210 have been tampered with or opened. For example, caps 212 may have a detachable ring or another suitable portion that may detach from caps 212 when caps 212 are first removed. Accordingly, a user may determine that caps 212 have been removed or fitments 210 have otherwise been tampered with by determining whether the ring (or other portion) of caps 212 is no longer attached. Alternatively, a seal (not shown) that is removable, penetrable, or may be broken, to facilitate or allow alcohol to flow, may be used. Other suitable indicators may be used to determine whether caps 212 have been removed or tampered with in other embodiments.

In one embodiment, an alignment plate 214 (see FIGS. 2A and 2B) is coupled to a top portion of box 200 and is secured to box 200 by two or more latches (not shown) on opposing sides of alignment plate 214. Alignment plate 214 includes a plurality of fitment openings 216 to enable the outlets of each bag 206 to extend through alignment plate 214. Alignment plate 214 also includes two or more grip openings 218 to enable a user to grasp a portion of alignment plate 214 when attaching a connector assembly to alignment plate 214 and bags 206. Alignment plate 214 also includes a locking member opening 220 for receiving a locking member to removably attach alignment plate 214 to the connector assembly.

In one embodiment, the alignment plate 214 is transparent to enable a user to view bags 206 underneath alignment plate 214. In a further embodiment, the bags 206 are transparent to enable a user to view the contents of bag 206 and/or a fill level of bags 206.

In one embodiment, the top cover 204 is foldable or otherwise movable to either cover, or expose the top portion of box 200. For example, top cover 204 may be folded down into a closed position for shipping or transport. Additionally, or alternatively, the top cover 204 may be removable by a user to expose the top portion of box 200. For example, the top cover 204 may be removably attached to the box 200 by a perforated or pre-scored hinge that a user may tear off to remove top cover 204. In the closed position, the top cover 204 hides the alignment plate 214 and fitments 210 from view and protects the alignment plate 214 and the fitments 210 during transport. The top cover 204 may be latched in the secured position by a tab or latch 222. The top cover 204 may also be removed or folded up into an open position when a user wants to access fitments 210 or alignment plate 214, for example, in preparation for dispensing the contents of bags 206.

With specific reference to FIG. 1A, in an exemplary embodiment, the alignment plate 214 includes a plurality of fitment openings 216 and a locking member opening 220. In one embodiment, the fitment openings 216 are key-hole shaped to enable fitments 210 of each bag 206 to be easily inserted (through the larger portion of each opening 216) and to enable fitments 210 to be secured in a final attachment position (the smaller portion of each opening 216) to facilitate coupling fitments 210 to the connector assembly. Alternatively, fitment openings 216 may have any suitable shape.

The locking member opening 220 may be shaped to receive a portion of a locking member of the connector assembly 110. In one embodiment, the locking member opening 220 is circular. Alternatively, the locking member opening 220 may be any suitable shape.

Figure 2B:
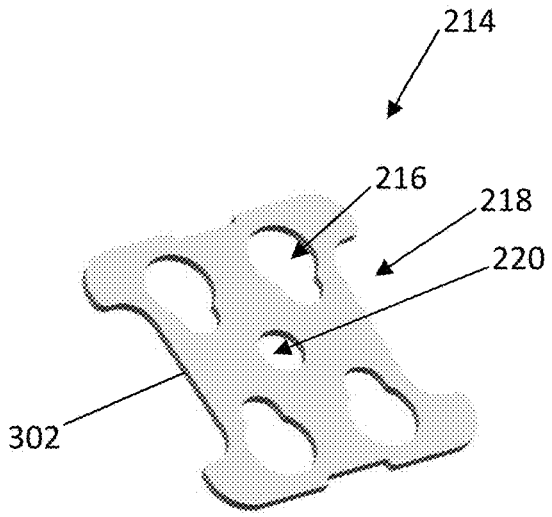
FIG. 2B is a perspective view of an exemplary alignment plate that may be used with the beverage dispensing package shown in FIG. 2.

In the illustrated embodiment, the alignment plate 214 also includes two grip openings 218 defined therein to enable a user to grasp a grip portion 226 of the alignment plate 214. While two grip openings 218 are shown in FIG. 2B, it should be recognized that any suitable number of grip openings 218 may be formed in alignment plate 214.

Figure 2C:
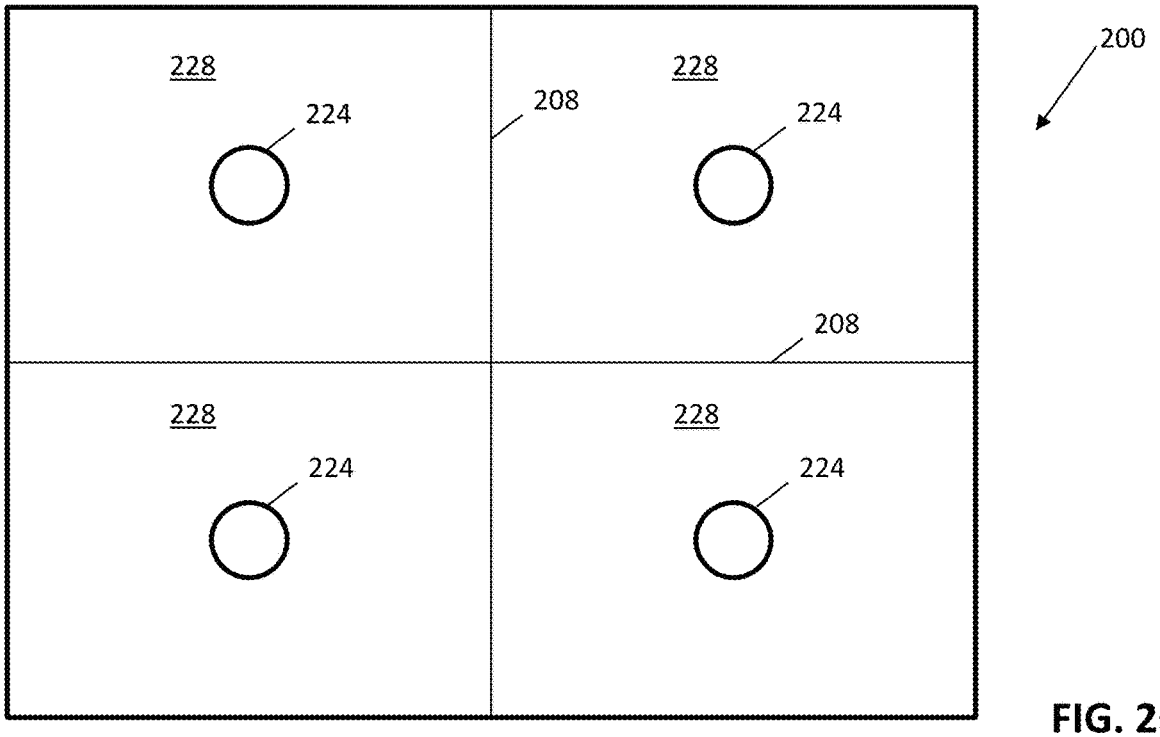
FIG. 2C is a block diagram showing a top view of the beverage dispensing package of FIG. 2 with an alignment plate and fitment caps removed.

FIG. 2C is a block diagram showing a top view of the beverage dispensing package or box 200 with the alignment plate 214 and the caps 212 removed. As illustrated in FIG. 2C, the box 200 may include a plurality of dividers 208 that form a plurality of compartments 228 within the box 200. While two dividers 208 are shown as forming four compartments 228, it should be recognized that any suitable number of dividers 208 and compartments 228 may be included within each box 200.

In an exemplary embodiment, a separate bag 206 is positioned within each compartment 228. Each bag 206 includes a respective outlet 224 for dispensing the contents of bag 206 (e.g., alcoholic beverages). Each outlet 224 is separated from each other so that the outlets 224 (and therefore, the contents of each bag 206) are not in fluid communication with each other. This is sometimes referred to as being in a "divorced" state.

As illustrated in FIG. 2C, the box 200, compartments 226, and bags 206 may have a substantially square or rectangular cross-section to enable bags 206 and boxes 200 to be stacked on top of each other during transport or during operation (i.e., during the dispensing of the alcoholic beverages). Alternatively, the boxes 200, compartments 228, and bags 206 may have any suitable shape or cross-section as desired. Further examples of box 200, compartments 228, and bag 206 shapes are illustrated in FIGS. 5 and 6A-6D.

FIGS. 3A-3B illustrate an alternative embodiment of a box 300 having elongated rectangular compartments 302 that may be used with beverage dispensing system 100 (shown in FIG. 1). While six rectangular compartments 302 are illustrated in FIGS. 3A-3B, any suitable number and shape of compartments 302 may be used with the box 300.

Figure 3:
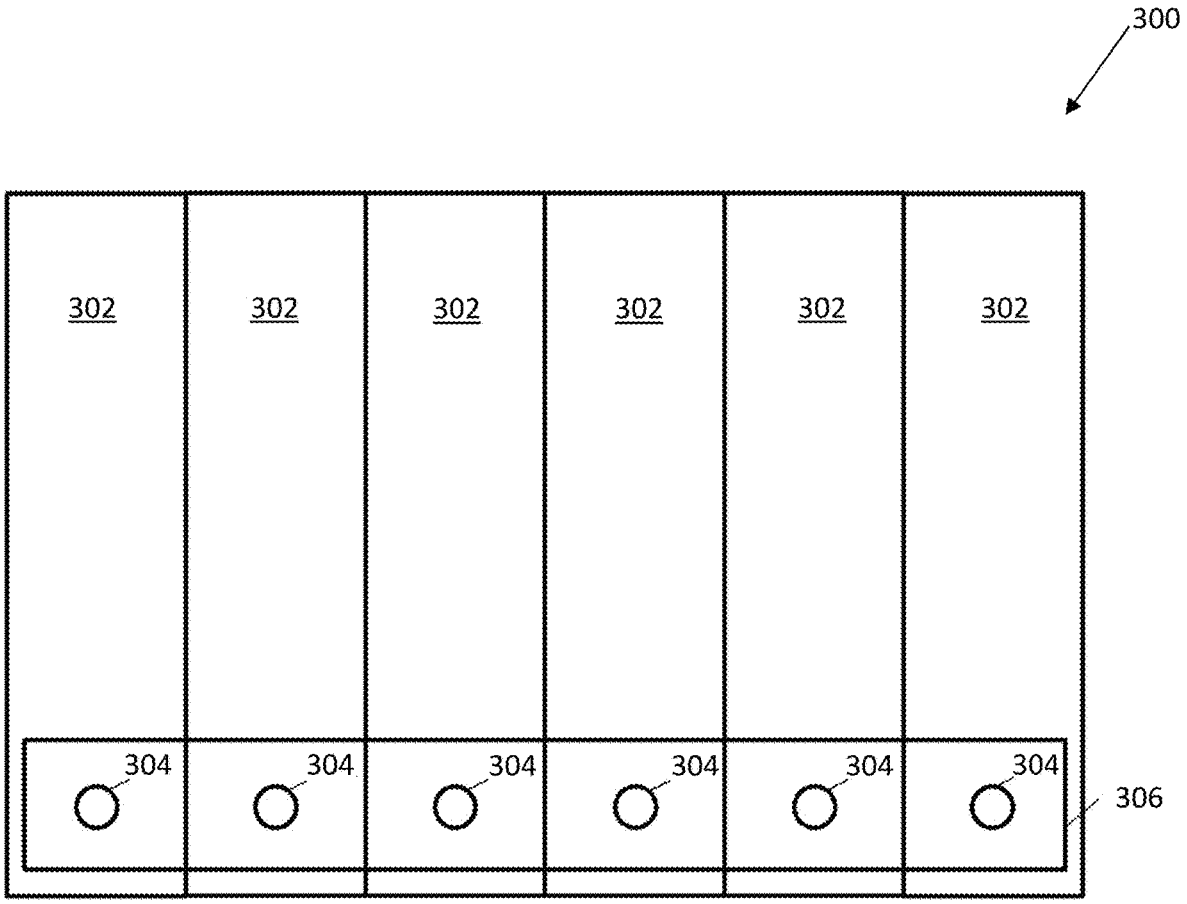
FIG. 3 illustrates an alternative embodiment of a beverage dispensing package having elongated rectangular compartments that may be used with the beverage dispensing system shown in FIG. 1.
Figure 4A:
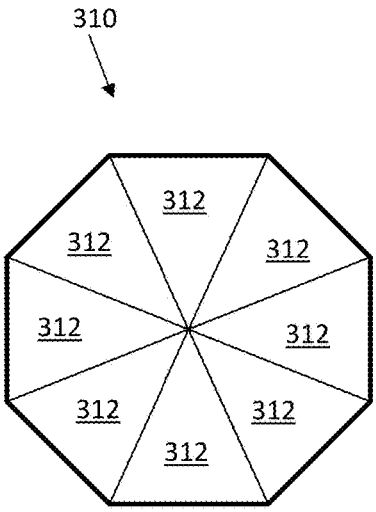
FIGS. 4A-4D illustrate alternative beverage dispensing packages and associated containers that may be used with the beverage dispensing system shown in FIG. 1.
Figure 4B:
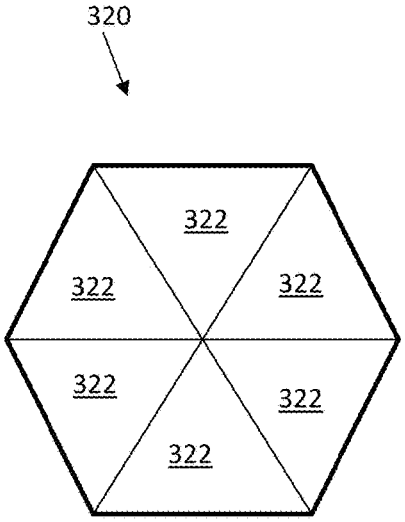
Figure 4C:
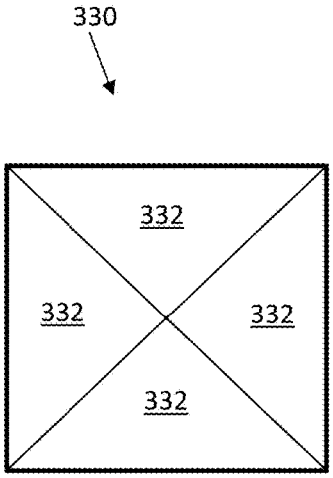
Figure 4D:
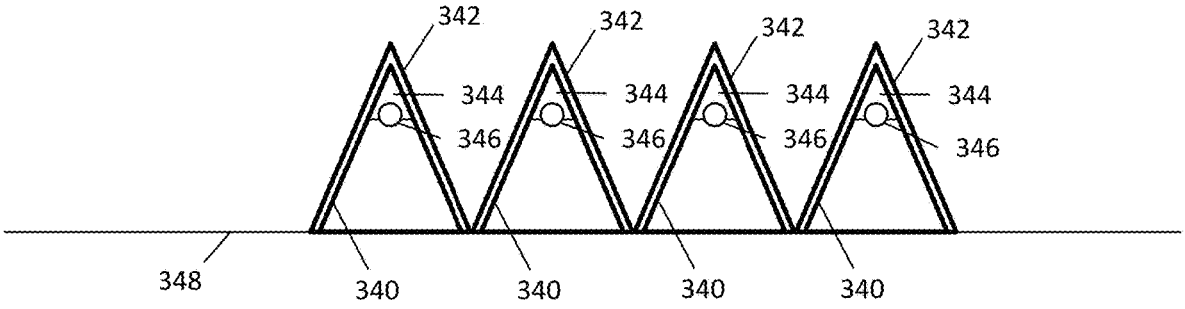

In the embodiment shown in FIG. 3, a bag (not shown) having a rectangular cross-section is placed within each compartment 302, and an outlet 304 of each bag is positioned near a bottom portion of each compartment 302. Alternatively, outlets 304 may be positioned in any suitable location with respect to the bags or compartments 302. A rectangular alignment plate 306 is coupled to the bags and outlets 304 in a similar manner as described above with reference to FIGS. 2A-2C.

Figure 6A:
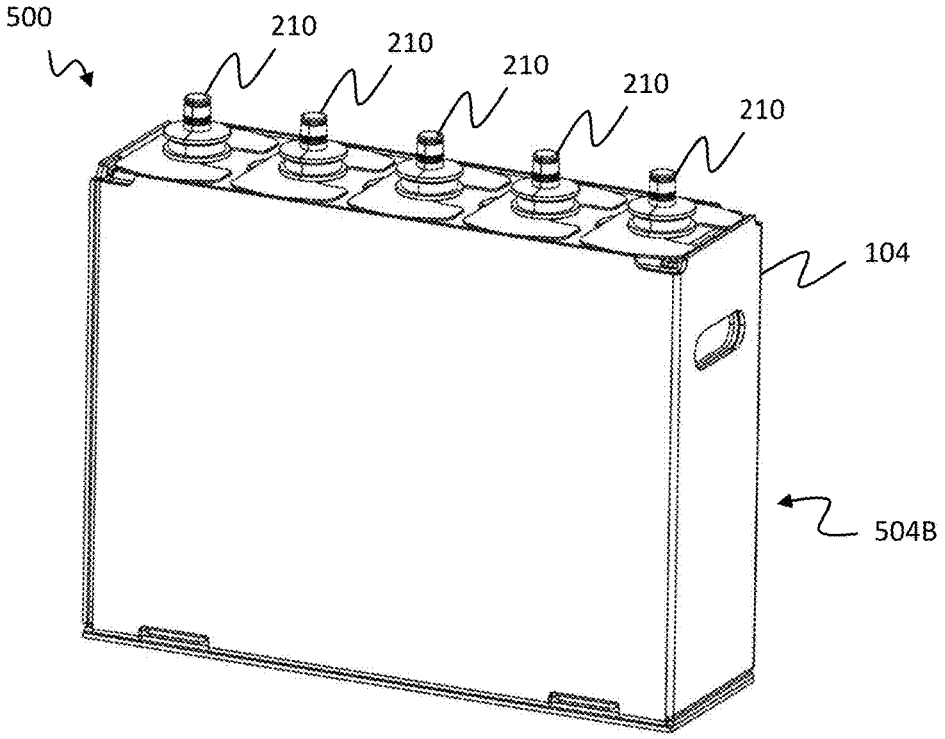
FIG. 6A is a perspective view of a multi-bag package (MBP) or box for use with the MBC assembly of FIG. 5A.
Figure 6B:
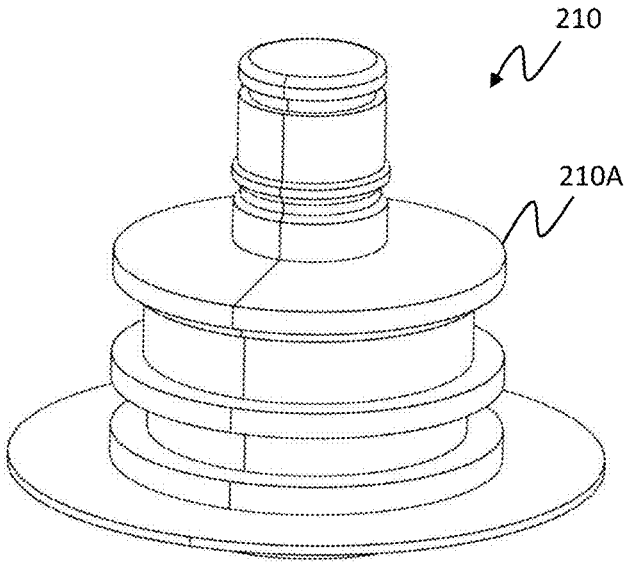
FIG. 6B is a perspective view of a fitment of the MBP of FIG. 6A.

FIGS. 4A-4D illustrate alternative boxes and associated bags that may be used with beverage dispensing system 100 (shown in FIG. 1). FIG. 3A is a block diagram of a substantially octagonal box 310. FIG. 6B is a block diagram of a substantially hexagonal box 320. FIG. 6C is a block diagram of a substantially square box 330. Each of the boxes 310, 320, 330 form a plurality of compartments 312, 322, 322 with a triangular cross-section.

FIG. 3D illustrates bags 340 having a substantially triangular cross-section that may be used with the boxes 310, 322, 332 shown in FIGS. 3A-3C.

Referring to FIG. 3D, a plurality of bags 340 having a triangular cross-section may be used with the boxes shown in FIGS. 3A-3C. The bags 340 may be housed or positioned within an intermediate container 342. Each bag 340 may include an alignment portion 344 that may be used to correctly position a respective fitment 346 with the box 310, 320, 330.

Each intermediate container 342 may be coupled to a common edge 348 that may form the exterior of the box 310, 320, 330. For example, in one embodiment, each intermediate container 342 is coupled to a common piece of cardboard that may be folded to form the box 310, 320, 330. Thus, if four intermediate containers 342 and associated bags 340 are provided, containers 342 may be folded along edge 342 to form the square box 330 shown in FIG. 3C. It should be recognized that other suitable shapes may be used for intermediate containers 342 and bags 340 to form a box of any suitable shape and size. It should also be recognized that intermediate containers 342 may be connected together along different edges to form boxes of any desired shape and configuration.

Other details of a beverage dispensing system and connector assembly are shown in U.S. Pat. No. 10,233,003, issued Mar. 19, 2019, and U.S. Pat. No. 10,538,424, issued on Jan. 21, 2022, both of which are herein incorporated by reference.

As discussed in more detail below, an external connector assembly 110 is utilized to controllably, fluidly couple the outlet for the bags or containers 106 within a box 104. In general, the connector assembly 110, which may be referred to as a multi-bag connector or MBC assembly 110, includes a valve assembly 112 used to connect the outlet 224 of each bag 106 to the system 100. The valve assembly 112 connects the outlet 224 of the bags 106 together to jointly direct liquids from the bags 224 to a common main outlet 114 of the valve assembly 112.

As is described more fully herein, the components of the connector assembly cooperate together to enable a user to quickly, and accurately, attach the MBC assembly 110 to the MBP 104 when the user prepares the beverage dispensing system 100 for use. The components of the connector assembly 110 also cooperate together to enable the user to disengage the MBC assembly quickly and efficiently 110 from the MBP 104, for example, when the user wishes to replace empty bags or boxes with filled replacement bags or boxes.

Figure 5:
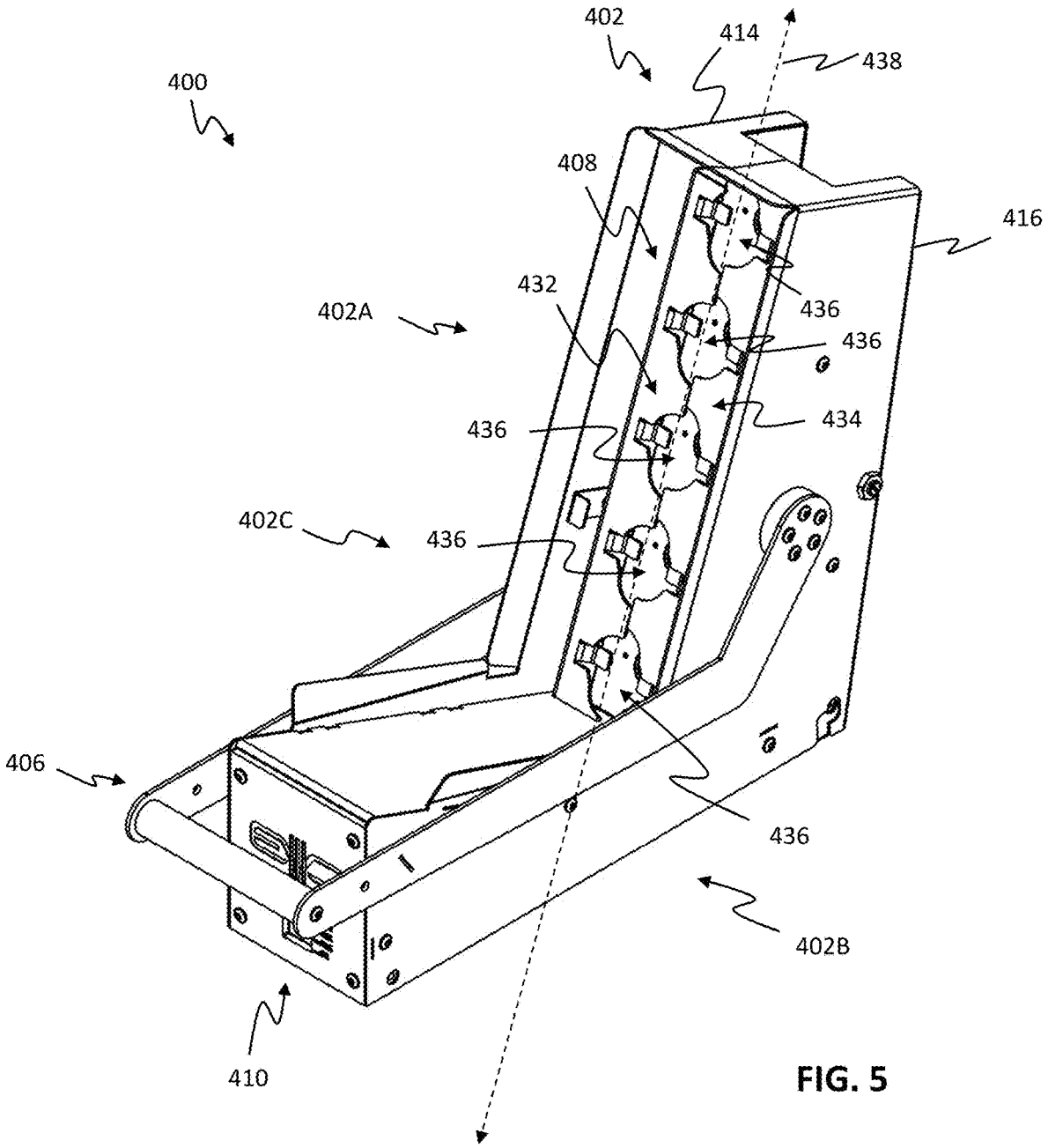
FIG. 5 is a perspective view of a multi-bag connector (MBC) assembly in an open position, according to an embodiment of the present invention, in an open position.

With reference to FIG. 5, an exemplary multi-bag connector (MBC), or connector, assembly 400 according to an embodiment of the present invention is shown. As discussed above, the MPC assembly 400 controllably couples a plurality of containers or bags 106 containing a liquid. The containers 106 are contained within a common package or box 104. Each container 106 has a fitment 210 (see FIGS. 6A-6B). Each fitment 210 has a channel and a flange 210A and configured to releasably connect a respective container 106 to the connector assembly 400. The containers 106 may be housed in a box 200 with the fitments 210 arranged in predetermined relative locations.

In the illustrated embodiment, the MBC 400 includes a housing 402, a valve assembly (not shown), an actuator 406, and a locking plate assembly 408. The housing 402 includes a lower portion 402A and an upper portion 402B. The upper portion 402A extends from the lower portion 402B. The lower portion 402A and the upper portion 402B form a recess 402C for receiving the box or package 104.

The actuator 406 is rotatably coupled to the housing 402. The actuator 406 is movable between an open (or first) position (shown in FIG. 5), a closed (or second) position, and an engaged (or third) position.

The locking plate assembly 408 includes a first plate 430 and a second locking plate 432. The first and second locking plates 430, 432 are coupled to the actuator 406 form an opening 436 corresponding to each fitment 210. The openings 436 have a variable diameter as a function of the position of the actuator 406. In the illustrated embodiment, the opening 436 have has a first diameter (or diameter value) when the actuator 406 is in the open position and a second diameter (or diameter value) when the actuator 406 is in the closed and engaged positions. The first diameter of the openings 436 are configured to allow entry of the flange 210A of each fitment 210 into the respective opening 436. Movement of the actuator 406 from the open position to the closed position closes the openings 436 to the second diameter (or diameter value). The second diameter is smaller than the first diameter and is also smaller than a diameter of the fitments 210.

Further movement of the actuator 406 from the closed position to the engaged position, results in movement of the locking plate assembly 408 towards the rear of the housing 402, and the valve assembly. With a package or box 104 within the recess 402 of the housing 400, when the locking plate assembly 408 is moved towards the valve assembly 404, since the variable diameter, $d_{variable}$, is smaller than a diameter of the fitments 210, the box or package 104 is drawn towards the rear of the housing 402 of the MBC assembly 400 such that the fitments 210 and the bags 106 are in fluid communication with the valve assembly 112. Essentially, the locking plate assembly 408 "grabs" the fitments 108 and pulls the fitments 108 and the package 104 towards the valve assembly 112 such that the fitments 108 are connected to the corresponding valve inlets or apertures.

With reference to FIGS. 7A-7E, 8A-8E, and 9A-9D, a package 500 for receiving a plurality of containers (or bags) 106. As discussed above, each of the bags 106 have a fitment 108 and contain a liquid, such as a beverage. More specifically, each bag 106 may contain an alcoholic beverage and have a volume of 1.8 liters. The package 500 includes an inner box 502 and an outer box 504. As discussed below, the inner box 502 has an inner volume 506 separated into a number of compartments 510. In the illustrated embodiment the inner box 502 is separated into five compartments 510 hold five separate bags 106. It should be noted that the inner volume 506 may be separated into any number of compartments 508.

Once assembled, each of the bags 106 is located within an associated compartment 508. The fitment 108 of each bag 106 is located outside of the inner box 502. The inner box 502 is located within the outer box 504. When the outer box 504 is closed (see below), the fitments 108 are located therein to protect the fitments 108 during shipping and storage.

The outer box 504 includes a lower portion 504A and a top portion 504B. The top portion 504B is removable such that the fitments 108 are exposed (as shown in FIG. 6A) and the package 500 is ready to be connected via the MBC assembly 110.

Figure 7A:
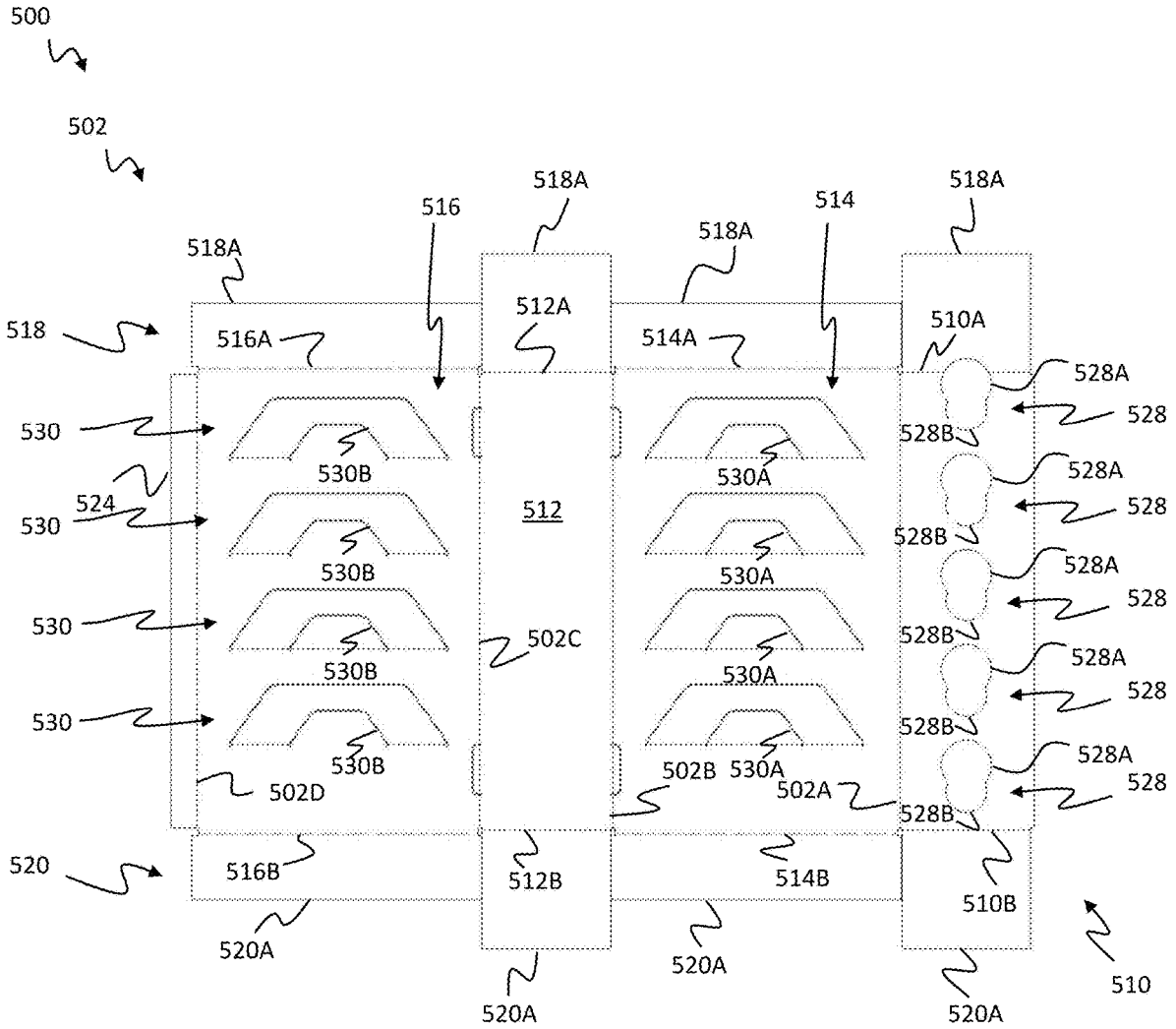
FIG. 7A is a top view of a blank or unassembled inner box of the MBP of FIG. 6A, according to an embodiment of the present invention.
Figure 7B:
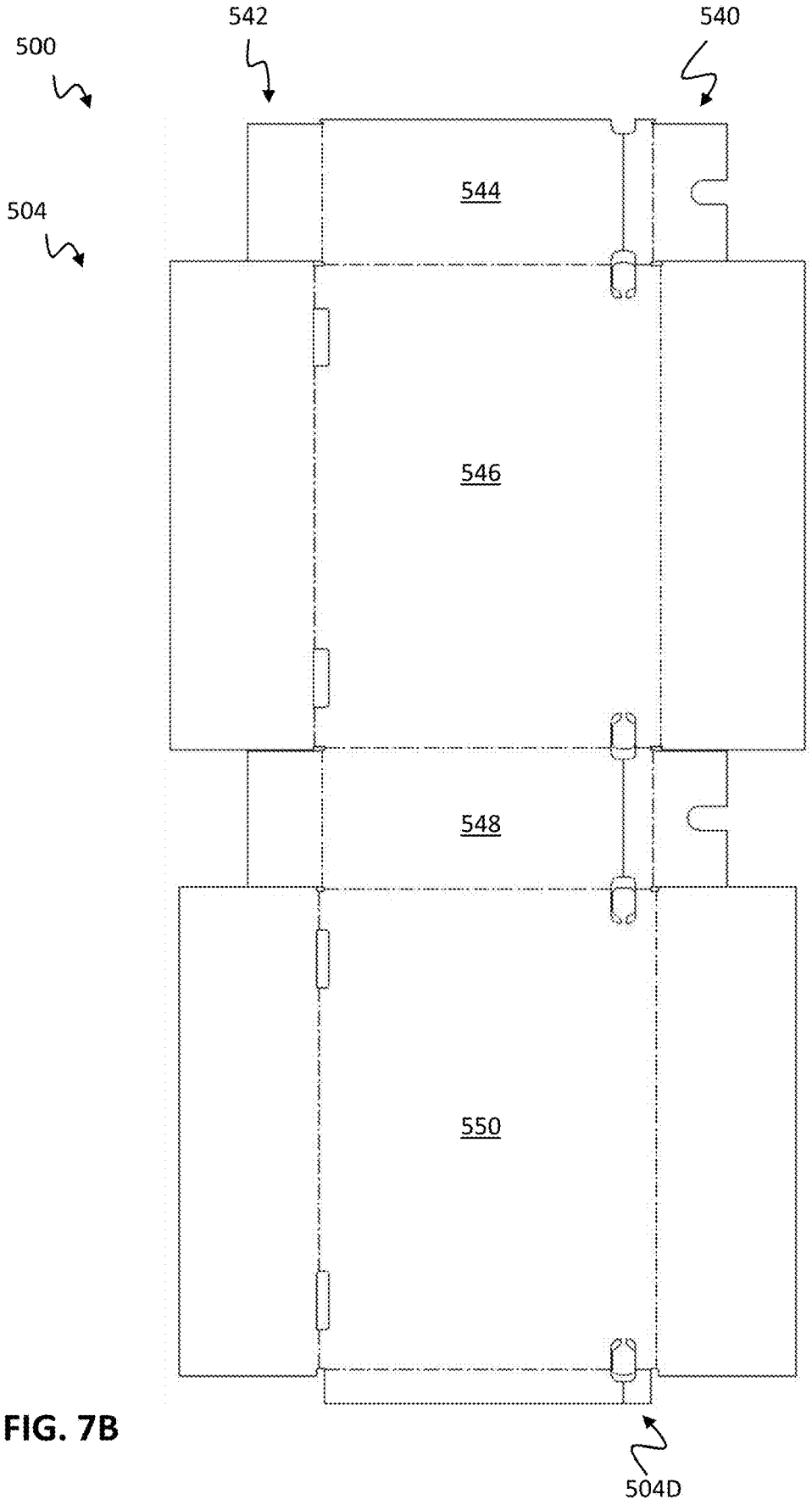
FIG. 7B is a top view of a blank or unassembled outer box of the MBP of FIG. 6A, according to an embodiment of the present invention.

With specific reference to FIGS. 6A, 7A, 8A-8E and 9A, the inner box 502 includes a top panel 510, a bottom panel 512, and first, second, third and fourth side panels 514, 516, 518, 520. The inner box 502 may be made from a paper product, such as cardboard, or some other suitable material. A blank or form 522 of the inner box 502 in an unassembled form is shown in FIG. 7A. The inner box 502 may be shipped or stored in a pre-assembled form, flat as shown in FIG. 7A. The inner box 502 includes a first tab portion 524. The first tab portion 524 may be fastened or attached, for example using glue, to an inner surface of the top panel 510. When the first tab portion 524 is fastened to the top panel 510, the top panel 510 and the first side panel 514 may be folder over to lay adjacent to the second side panel 516 and the bottom panel 512 and shipped or stored in a doubled-over flat configuration.

The top, bottom, first, second, third and fourth panels 510, 512, 514, 516, 518, 520 are connected together, and when assembled, define the inner volume 506 to receive the plurality of containers. The top panel 510 includes a plurality of apertures 528. Each aperture 528 is associated with the fitment 108 of a respective container 106. The apertures 528 are configured to allow the respective fitment 108 to be positioned outside of the inner volume 506.

As discussed in further detail below, the inner box 502 includes one or more inner support panel 530 located within the inner volume 506 to separate the inner volume 506 into the plurality of compartments 508. Each compartment 508 is configured to receive one of the plurality of containers or bags 106.

In the illustrated embodiment shown in FIG. 7A, the first side panel 514 is hingedly coupled is hingedly coupled to the top panel 510 at a first edge 502A. The bottom panel 512 is hingedly coupled to the first side panel 514 at a second edge 502B. The top panel 510 and the bottom panel 512 are located at opposite sides of the first side panel 514. The second side panel 516 is hingedly coupled to the bottom panel 512 at a third edge 502C. The first and second panels 514, 516 are located on opposite sides of the bottom panel 512. The tab 524 is located adjacent the second side panel 516 at a fourth edge 502D. The tab 524 and the bottom panel 512 are located on opposite side of the second side panel 516. After (at least partial) assembly of the inner box 502, the first, second, third and fourth edges 502A, 502B, 502C, 502D form the corners of the inner box 502 (see FIG. 8A).

In one embodiment (as shown in FIG. 7A), the third side panel 518 including at least one third side panel flap 518A hingedly coupled to an adjacent side edge of one of the first and second side panels 514, 516. In the illustrated embodiment, the third side panel 518 includes a third side panel flap 518A hingedly couped to each of the top panel 510, the bottom panel 512, the first side panel 514, and the second side panel 516 at a respective first adjacent side edge 510B, 512B, 514B, 516B. In an alternative embodiment shown in FIG. 8A, the two smaller side flaps 518B hingedly coupled to the top panel 510 and the bottom panel 512, respectively. A third side panel foldable panel 518C is hingedly coupled to the second side panel 516 and a locking third panel flap 518E is hingedly coupled to the third side panel foldable panel 518C. A slot 518D is located between the third side panel foldable panel 518C and the locking third panel flap 518E. A locking tab 518F is coupled to the first side panel 516.

The fourth side panel 520 includes at least one fourth side panel flap 520A hingedly coupled to an adjacent side of one of the first and second side panels 514, 516. In the illustrated embodiment, the fourth side panel 520 includes a fourth side panel flap 520A hingedly coupled to each of the top panel 510, the bottom panel 512, the first side panel 514, and the second side panel 516 at a respective second adjacent side edge 510A, 512B, 512C, 512D.

The package 500 further includes at least one inner support panel 530 located within the inner volume 506 to separate the inner volume 506 into a plurality of compartments 508. Each compartment 508 is configured to receive one of the plurality of containers or bags 106. In the illustrated embodiment, the inner box 502 is configured to hold five containers or bags 106. Thus, the package 500 includes four inner support panels 530 in order to divide the inner volume 506 into five compartments 508.

In one embodiment, each of the inner support panels 530 are formed by a first cutout 530A in the first side panel 514 and a second cutout 530B in the second side panel 516. Each inner support panel 530 comprises one of the first cutouts 530A and an opposing one of the second cutouts 530B. In the illustrated embodiment, the opposing first and second cutouts 530A, 530B are folded inward (towards the inner volume 506) after a container or bag 106 has been inserted below the corresponding inner support panel 530.

Figure 7C:
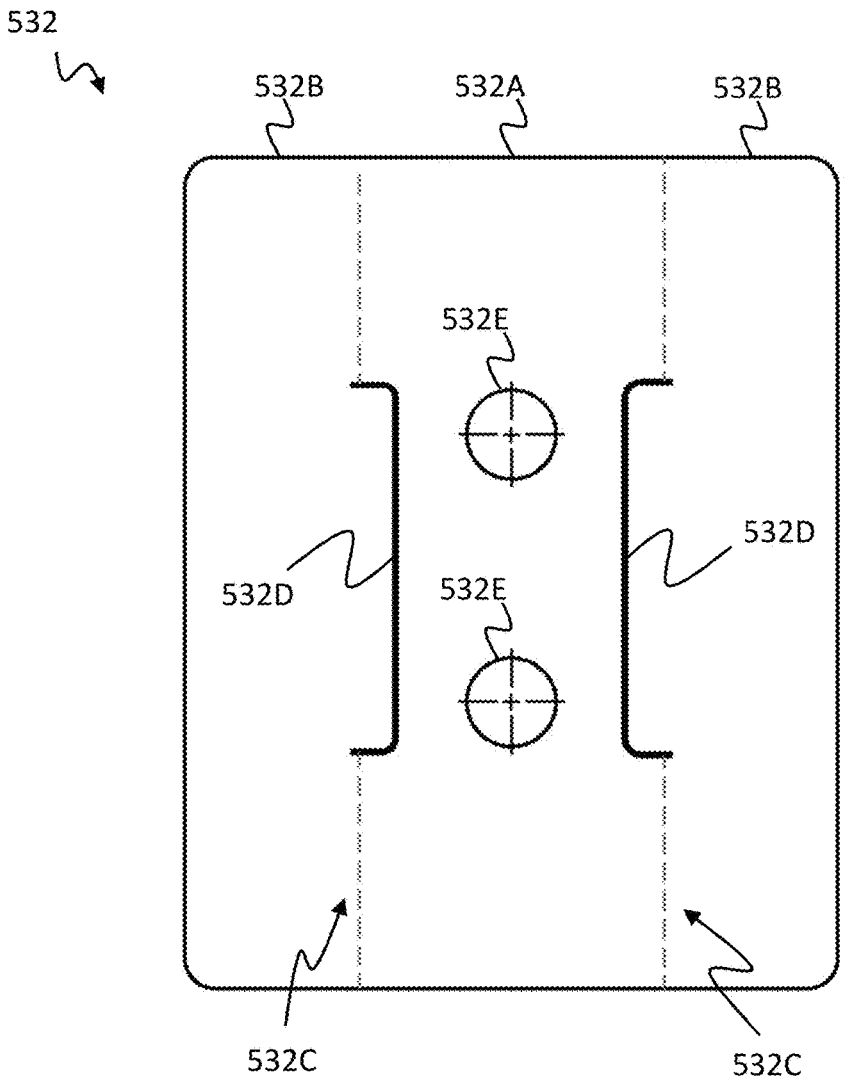
FIG. 7C is a top view of a blank of an inlay support panel of the MBP of FIG. 6A, according to an embodiment of the present invention.
Figure 7D:
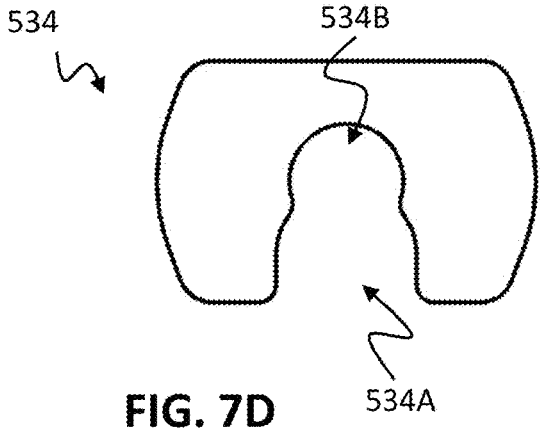
FIG. 7D is a top view of a blank of a separate key of the MBP of FIG. 6A, according to an embodiment of the present invention.
Figure 7E:
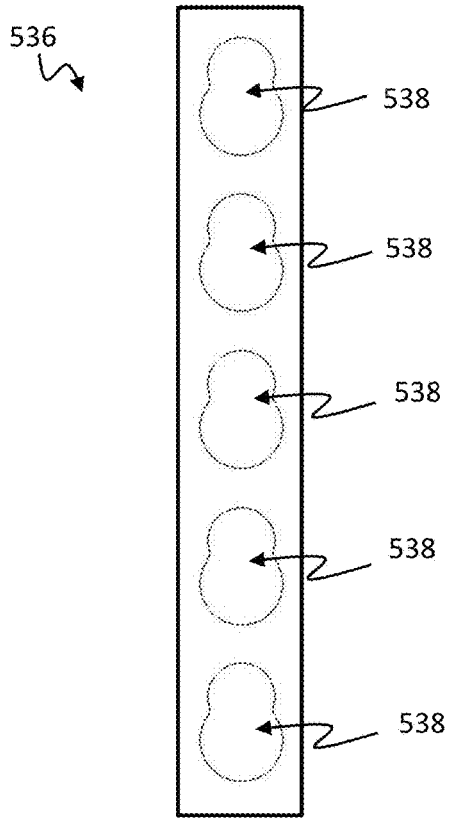
FIG. 7E is a top view of a pan integrated key panel of the MBP of FIG. 6A, according to an embodiment of the present invention.
Figure 7F:
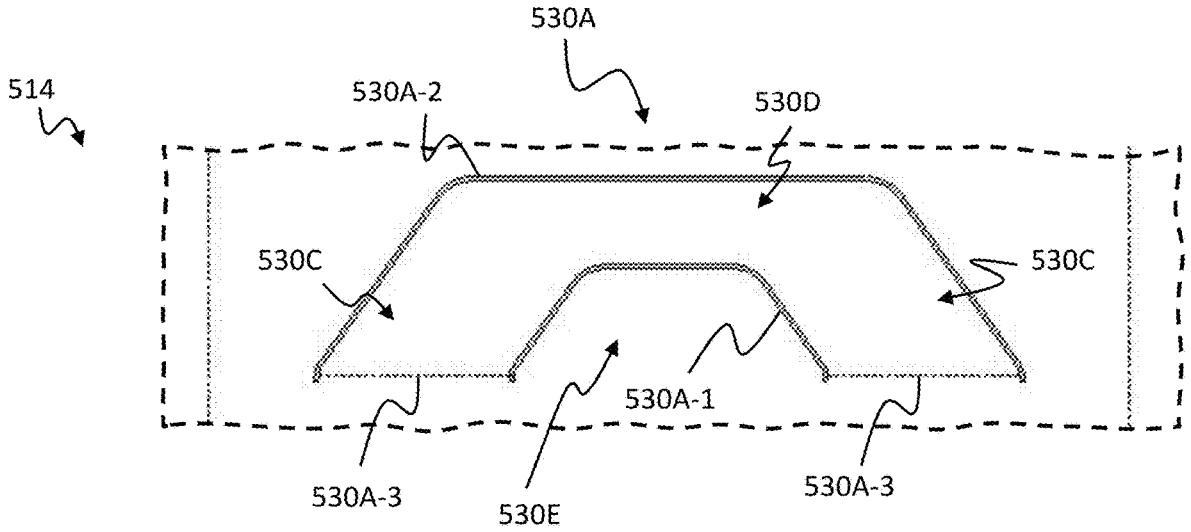
FIG. 7F is a view of a portion of a side panel of the MBP of FIG. 6A with a cutout form a portion of a support panel, according to an embodiment of the present invention.

With specific reference to FIG. 7F, an enlarged portion a first cutout 530A in the first side panels 514 with one of the first cutouts 530A is shown. The other first cutouts 530A and the second cutouts 530B in the second side panel 516 are the same or similar. The first cutout 530A is defined by an inner line segment 530A-1, an outer line segment 530A-2 and a pair of hinges 530A-3. The inner and outer line segments 530A-1, 530A-2 may be fully cut or perforated and define the shape of the cutout 530A. In the illustrated embodiment, the cutout 530A has a bridge-like shape with first and second ramp portions 530C joined by a span portion 530D. Underneath the span portion 530D, the inner line segment 530A-1 defines a rigid portion 530E that remains flush with the rest of the side panel 514 to provide structural rigidity to the side panel 514 when the cutout 530A is folded inward. The rigid portion 530E also assists in retaining the container or bag 106 from bulging outside of the inner box 502. To provide support to the bags 106 when located within the interior volume 506, the cutouts 530A, 530B are folded inward about the hinges 530A-3 which may be formed by a pressing or crease within the material of the side panel 514.

With reference to FIG. 7C, an optional separate inlay support panel 532 may be used to provide additional support between the bags 106 when assembled. Each inlay support panel 532 includes a main support panel 532A and two wing panels 532B. As discussed in further detail below, after a bag 106 is positioned within a compartment 508 in the inner volume 506, adjacent first and second cutouts 530A, 530B are folded inward to form a part of the inner support panel 530. If used, the inlay support panel 532 may then be inserted into the inner volume 506. The main support panel 532A is positioned adjacent the first and second cutouts 530A, 530B to provide addition support. The wing portions 532B are at least bent from the main support panel 532A and positioned against the inner walls of the inner box 502 to assist in keeping the main support panel 532A in place (see FIG. 8B).

In the illustrated embodiment, the wing portions 532B are separated from the main portion 532A by respective hinges 532C. A tab 532D cutout from the inlay support panel 532 may be provided along each hinge 532C. A pair of slots or openings 533 are formed in the inner (or interior) volume 506 (see FIGS. 8A-8B) when the cutouts 530A, 530B are folded inward. The tab 532D located on each side of the main portion 532A is received in a respective slot or opening 533 to position the inlay support panel 532A in the correct position. Further, the inlay support panel 532 may include a pair of apertures 532E within the main portion 532A to assist in proper placement of the inlay support panel 532 within the inner box 504.

In an alternative embodiment, only an inlay support panel 532 is used. In other words, the inlay support panel 532 comprises the inner support panel 530.

With specific reference to FIG. 7A, each aperture 528 in the top panel 510 includes an insert portion 528A and a retention portion 528B. The insert portion 528A is larger than the retention portion 528B for facilitating insertion of the respective fitment therein 210, the retention portion being configured to at least partially restrain movement of the respective fitment 210. Once a bag 106 is placed within a compartment 508 and the fitment 210 is placed through the insert portion 528A, the fitment 210 may then be moved towards the retention portion 528B. Once the fitment 210 is positioned within the retention portion 528B, the fitment 210 may be locked into place within the retention portion 528B by a respective key 534.

With reference to FIG. 7D, in one embodiment, as individual keys 534 are utilized. Each key 534 has an open end 534A and a key retention portion 534B. The open end 534A allows the key 534 to be placed around the fitment 210. Once the key 534 has been placed around the fitment 210, the key 534 may moved towards the fitment 210 such that the fitment 210 is located within the key retention portion 534B and locked in place between the retention portion 528B of the aperture 528 and the key retention portion 534B of the key 534. In use, the keys 534 are positioned about the fitments 210 such that the key insert portion 534A and the key retention position 534B are in a direction opposite the insert portion 528A and the retention portion 528B of the apertures 528 in the top panel 510.

In an alternative embodiment, a locking plate 536 with a plurality of integral locking keys 538 may be used in place of individual keys 534.

Figure 9A:
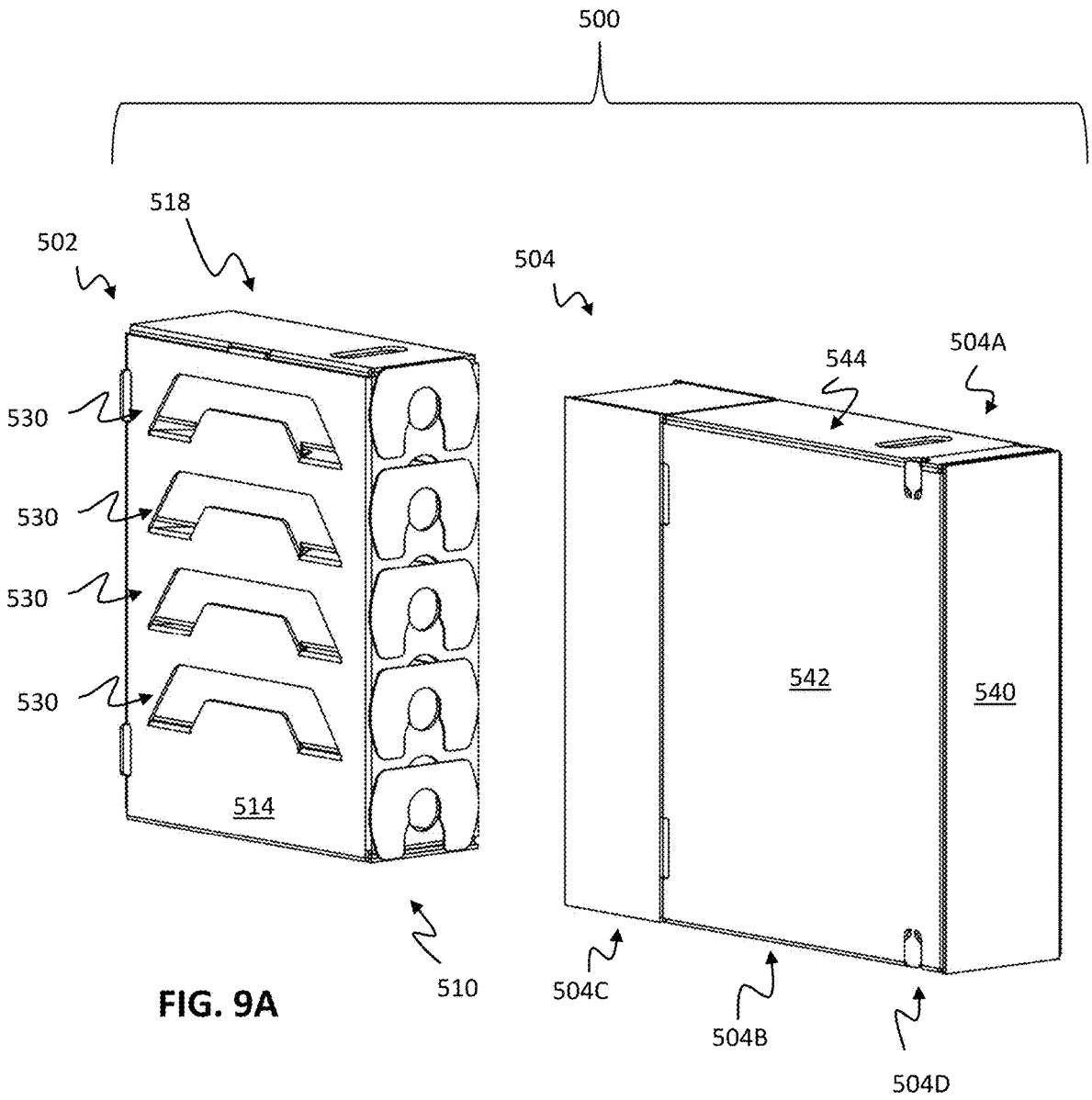
FIG. 9A is a perspective of an assembled inner box and outer box of the MBP of FIG. 6A.
Figure 9B:
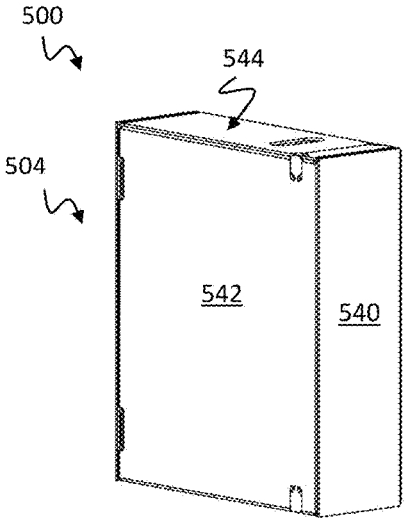
FIG. 9B is a perspective view of an assembled MBP.
Figure 9C:
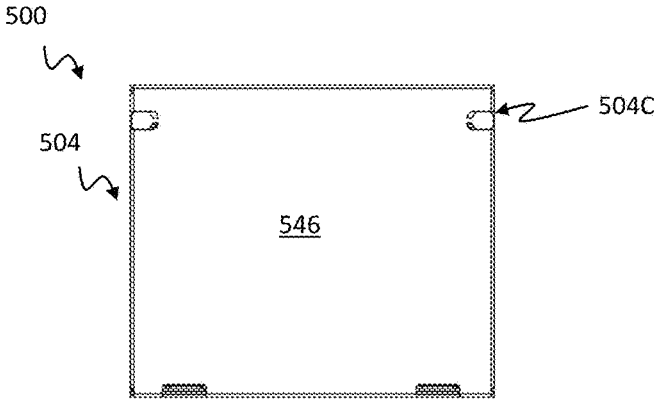
FIG. 9C is a first side view of the assembled MBP of FIG. 9B.
Figure 9D:
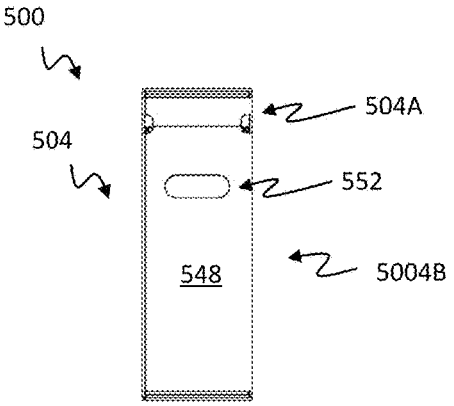
FIG. 9D is a second side view of the assembly MBP of FIG. 9B.

With specific reference to FIGS. 9A-9D, as discussed above, the inner box 502 may be placed within the outer box 504 for storage and/or shipping. The outer box 504 creates a sealed packaging solution that is mandatory to percent access or tampering with the contents of the inner box 502. The outer box 504 may be sized such to provide a slip fit between the inner and outer boxes 502, 504. The outer box 504 may include a top portion 504A and a bottom portion 504B. As shown in FIG. 9A, the outer box 504 has a bottom portion 504C consisting of one or more flaps which may be fastened together, for example, by an adhesive once the inner box 502 has been positioned therein. The outer box 504 may further include a tear-away opening mechanism 504D. When the package 500 is ready to be used, the tear-away opening mechanism 504D, may be used to release the top portion 504A from the bottom portion 504B to expose the fitments (see FIG. 6A).

The outer box 504 includes an outer box top panel 540, an outer box bottom panel 542, and first, second, third and fourth side panels 544, 546, 548, 550. With specific reference to FIG. 7B, a blank of the outer box 504 is shown.

The outer box 504 may have an integral aperture that forms a handle 552 in opposite side panels. In the illustrated embodiment, the handles 552 are located on opposite side panels 544, 548. In one embodiment the side panels 544, 548 are composed to two layers of material or cardboard. The handles 552 are formed by an aperture in the outer of the two layers to provide a gripping portion, i.e., the handle 552, the solid inner layer provides protection to the bags 206 located within the package 500 to prevent tampering or access to the bags 106 and the contents of the bags 106.

INDUSTRIAL APPLICABILITY

With reference to the drawings, and in operation, the present invention provides a package 500 for receiving a plurality of containers 206 containing a liquid. Each container 206 has a fitment 210. The package 500 includes an inner box 502 and an outer box 504.

Figure 8A:
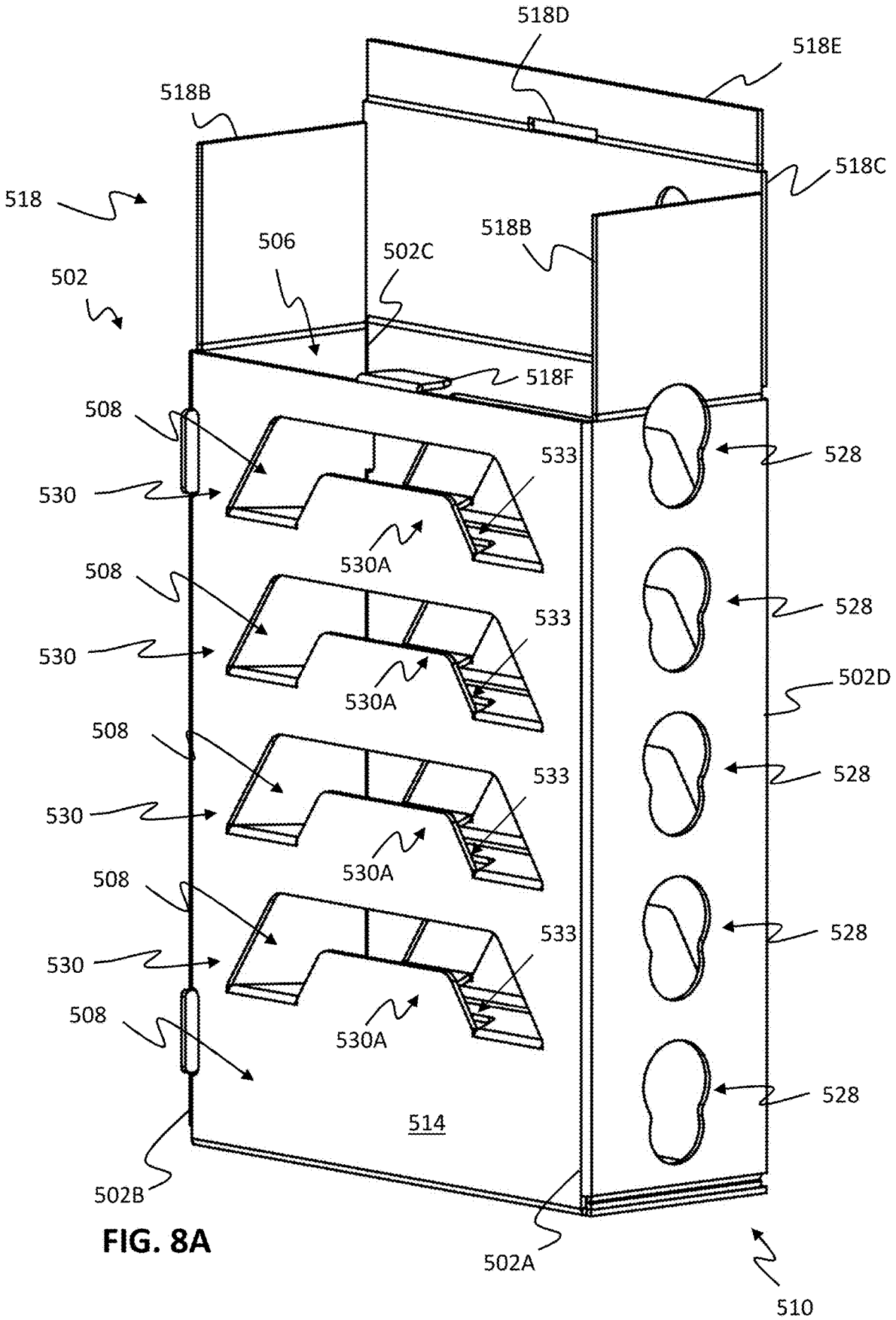
FIG. 8A is a perspective view of a partially assembled inner box of the MBP of FIG. 6A.
Figure 8B:
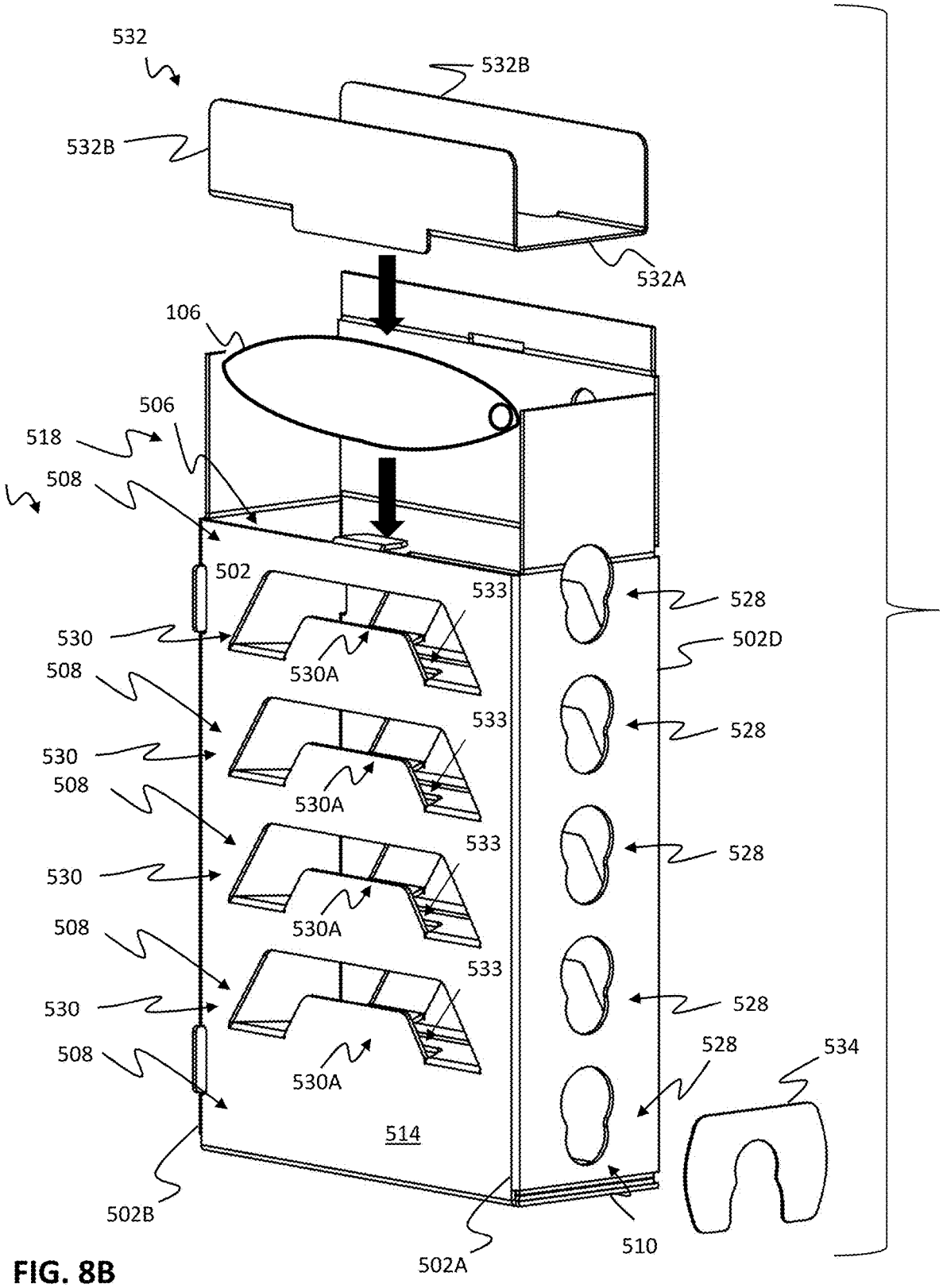
FIG. 8B is a perspective view of a partially assembled inner box of the MBP of FIG. 6A along with a key and optional inlay support panel.
Figure 8C:
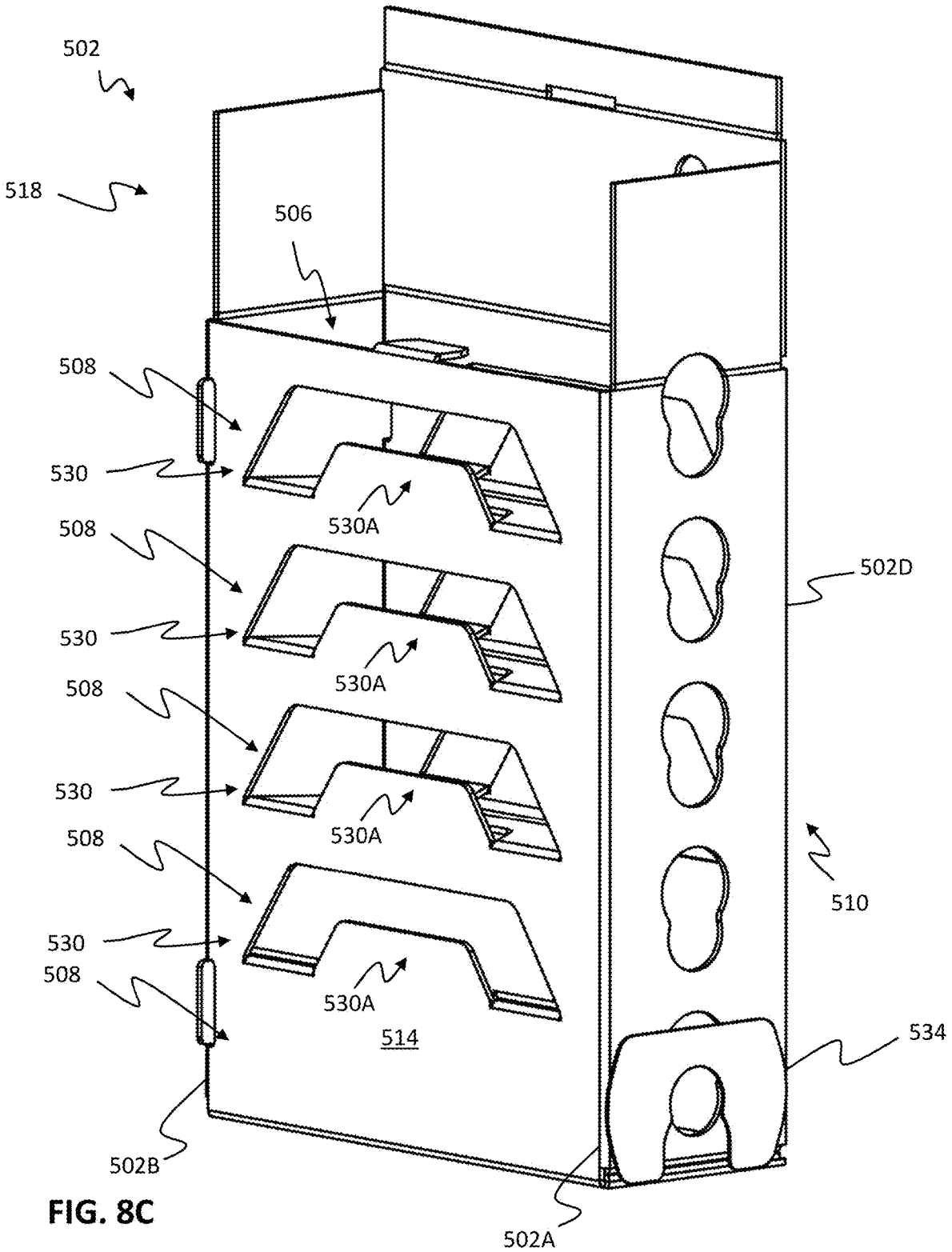
FIG. 8C is a perspective view of a partially assembled inner box of the MBP of FIG. 6A along with a key.
Figure 8D:
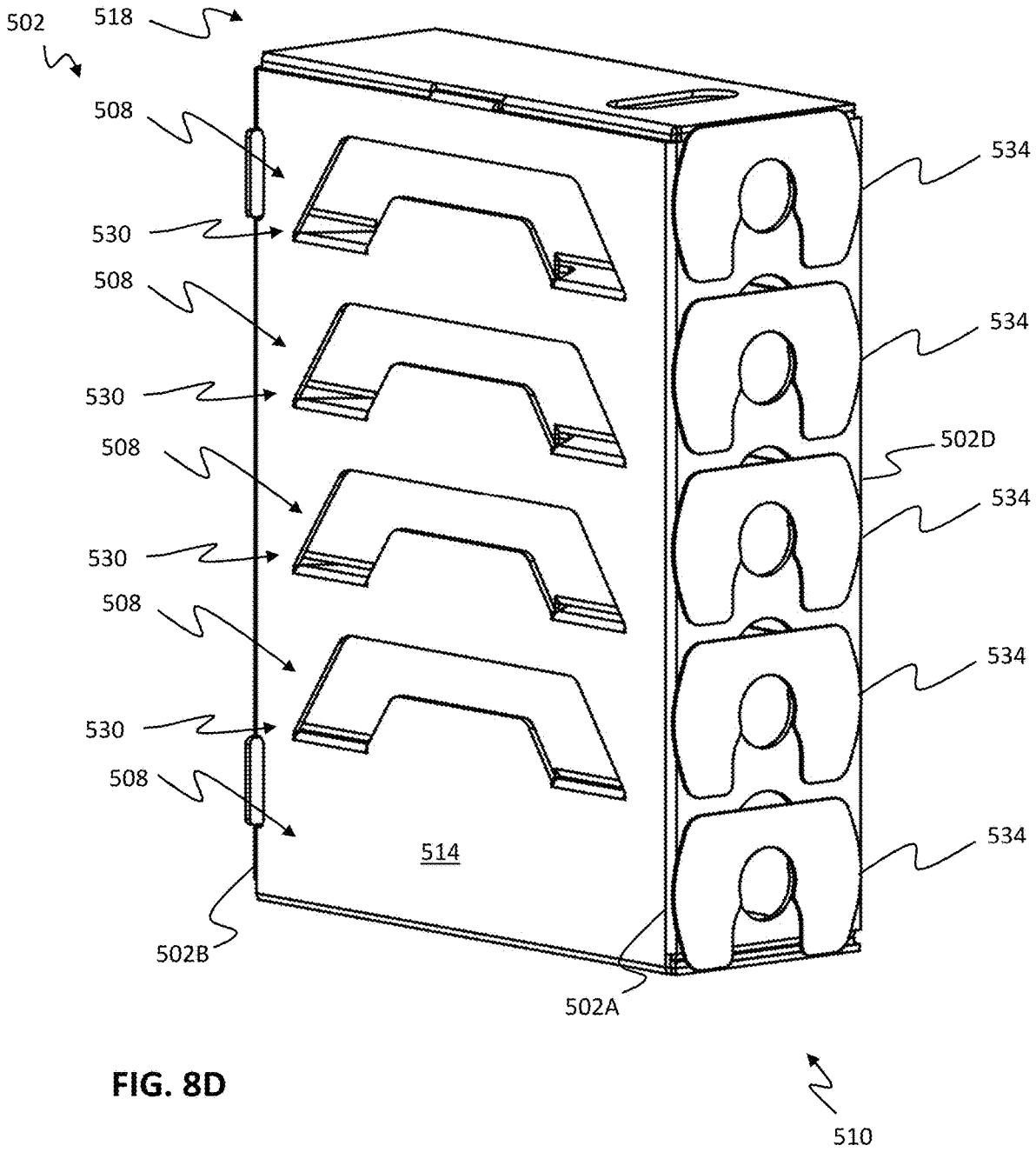
FIG. 8D is a perspective view of an assembled inner box of the MBP of FIG. 6A.
Figure 8E:
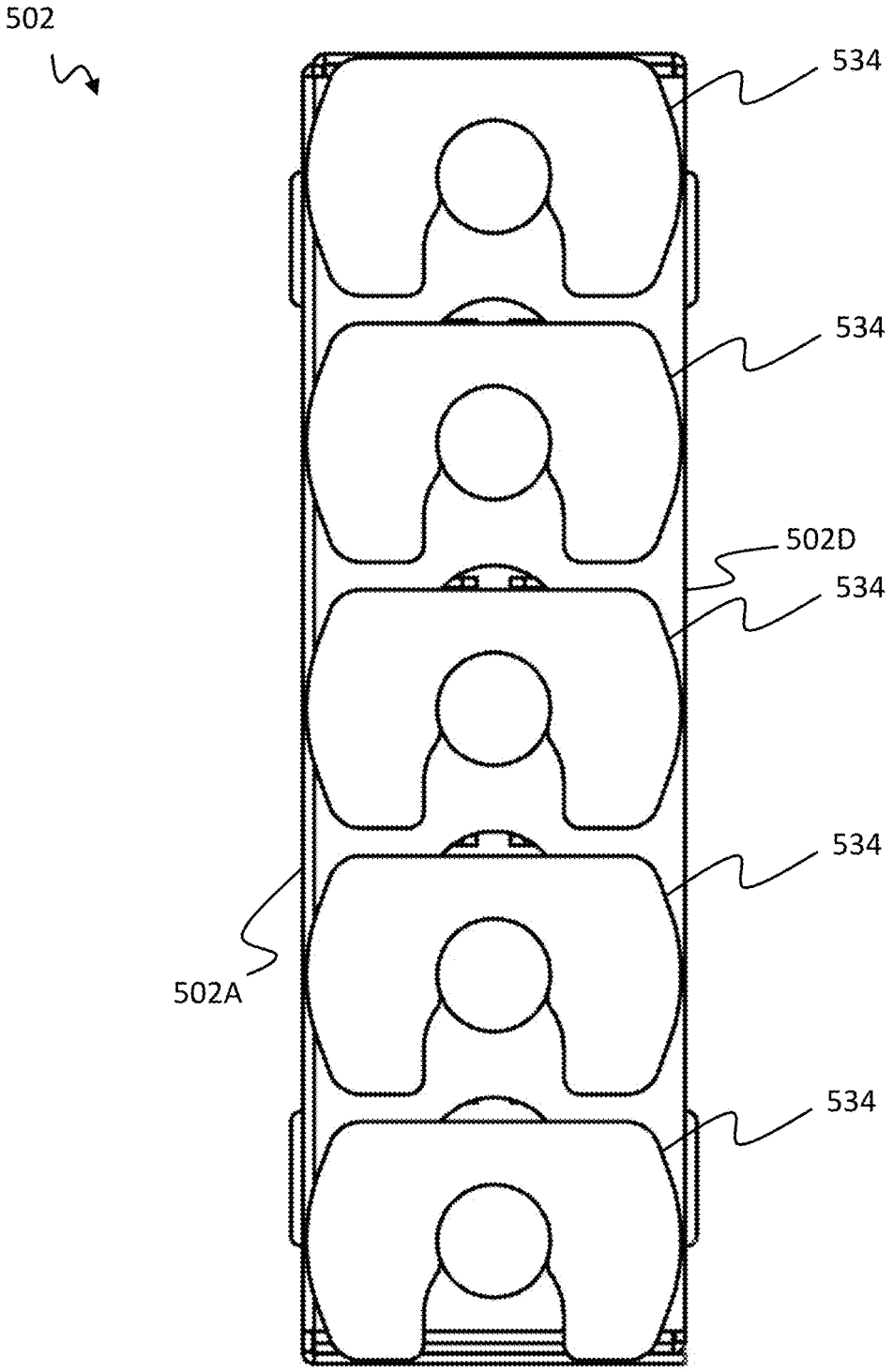
FIG. 8E is a front view of an assembled inner box of the MBP of FIG. 6A.

As shown in FIG. 8B, the inner box 502 prior to final assembly, the inner box 502 is partially assembled with the one of the side panels, e.g., the third side panel 518, being in an open configuration (see FIG. 8B. A first bag or container 106 is inserted into the inner volume 506. The respective fitment 210 is inserted into one of the apertures 528 and a respective key 534 is used to lock the fitment 210 in place. Alternatively, the locking plate 536 with the integral locking keys 538 may be used once all the bags 210 are in place.

Once each of the bags 210 are in place, the inner support panel 530 is put into place (prior to the next bag being inserted). In one embodiment, the inner support panel 530 includes opposing first and second cutouts 530A, 530B which are pushed/folded inward before the next bag is inserted. Optionally, an inlay support panel 532 may be used and inserted into the inner volume 506. Alternatively, the inner support panel 530 may be comprised solely of the inlay support panel 532.

Once, all of the bags 210 have been inserted, the third side panel 518 (which is in the open configuration) may be closed. In the first embodiment, shown in FIG. 7A, the third side panel flap 518A may be folded inward and then fastened together using an adhesive or glue. In the alternative embodiment shown in FIG. 8A, the two smaller side flaps 518B are folded inward and the third side panel foldable panel 518C is folded downward with the locking third panel flap 518E positioned inside the inner box 502. The locking tab 518F may then be inserted into the slot 518D to close the inner box 502.

The fully assembled inner bag 502 may then be placed within the outer box 504 which then be closed (using adhesive).

One or more of the steps may be performed by one or more assembly machines or may be performed manually.

Although specific features of various embodiments of the disclosure may be shown in some drawings and not in others, this is for convenience only. In accordance with the principles of the disclosure, any feature of a drawing or other embodiment may be referenced and/or claimed in combination with any feature of any other drawing or embodiment.

This written description uses examples to describe embodiments of the disclosure and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A box for receiving a plurality of containers containing a liquid, each container having a fitment, the box comprising:

a top panel, the top panel including a plurality of apertures;

a bottom panel;

first, second, third and fourth side panels, the top, bottom, first, second, third and fourth panels connected together defining an inner volume to receive the plurality of containers, each aperture of the top panel being associated with the fitment of a respective container and configured to allow the respective fitment to be positioned outside of the inner volume; and, an inner support panel located within the inner volume to separate the inner volume into a plurality of compartments, each compartment being configured to receive one of the plurality of containers, the inner support panel being formed from a first cutout of one of the first, second, third and fourth panels and a second cutout of another one of the first, second, third and fourth panels, the first and second cutouts being folded inward to form the inner support panel, wherein a pair of opposing slots are formed within the inner volume with the first and second cutouts folded inward; and, a separate inlay support panel configured to provide additional support to the inner support panel, the separate inlay support panel including a main support panel, two wing panels located on opposite side of the main support panel, and opposing tabs, each of the opposing tabs being positioned within a respective one of the opposing slots, each of the two wing panels being positioned against an inner wall of the box to assist in positioning of the main support panel.

2. The box, as set forth in claim 1, further comprising a plurality of keys, each key being configured to be positioned between an outer surface of the top panel and the respective fitment to lock the fitments in place relative to the top panel.

3. The box, as set forth in claim 2, wherein each aperture in the top panel includes an insert portion and a retention portion, the insert portion being larger than the retention portion for facilitating insertion of the respective fitment therein, the retention portion being configured to at least partially restrain movement of the respective fitment, the fitments being locked into place within the retention portion by a respective key.

4. The box, as set forth in claim 2, further including a locking plate, wherein the keys are located within the locking plate.

5. The box, as set forth in claim 2, wherein each key is separate from each other key.

6. The box, as set forth in claim 2, wherein each key has a key insert portion and a key retention portion, wherein during assembly, the keys are positioned about the fitments such that the key insert portion and the key retention position are in a direction opposite the insert portion and the retention portion of the apertures in the top panel.

7. A package for receiving a plurality of containers containing a liquid, each container having a fitment, the package comprising:

an outer box; and, an inner box within the outer box, the inner box, including:

a top panel, the top panel including a plurality of apertures;

a bottom panel;

first, second, third and fourth side panels, the top, bottom, first, second, third and fourth panels connected together defining an inner volume to receive the plurality of containers, each aperture of the top panel being associated with the fitment of a respective container and configured to allow the respective fitment to be positioned outside of the inner volume, the top panel of the inner box and the outer box defining a fitment volume outside of the inner box between the top panel and the outer box; and, an inner support panel located within the inner volume to separate the inner volume into a plurality of compartments, each compartment being configured to receive one of the plurality of containers, wherein the respective fitment may be positioned through a respective aperture in the top panel and located outside of the inner box within the fitment volume, the inner support panel being formed from a first cutout of one of the first, second, third and fourth panels and a second cutout of another one of the first, second, third and fourth panels, the first and second cutouts being folded inward to form the inner support panel, the first and second cutouts being folded inward to form the inner support panel, wherein a pair of opposing slots are formed within the interior volume with the first and second cutouts folded inward, the package further including a separate inlay support panel configured to provide additional support to the inner support panel, the separate inlay support panel including a main support panel, two wing panels located on opposite side of the main support panel, and opposing tabs, each of the opposing tabs being positioned within a respective one of the opposing slots, each of the two wing panels being positioned against an inner wall of the box to assist in positioning of the main support panel.

8. The package, as set forth in claim 7, further comprising a plurality of keys, each key being configured to be positioned between an outer surface of the top panel and the respective fitment to lock the fitments in place relative to the top panel.

9. The package, as set forth in claim 8, wherein each aperture in the top panel includes an insert portion and a retention portion, the insert portion being larger than the retention portion for facilitating insertion of the respective fitment the rein, the retention portion being configured to restrain movement of the respective fitment, the fitments being locked into place within the retention portion by a respective key.

10. The package, as set forth in claim 8, further including a locking plate, wherein the keys are located within the locking plate.

11. The package, as set forth in claim 8, wherein each key is separate from each other key.

12. The package, as set forth in claim 8, wherein each key has a key insert portion and a key retention portion, wherein during assembly, the keys are positioned about the fitments such that the key insert portion and the key retention position are in a direction opposite the insert portion and the retention portion of the apertures in the top panel.

13. A blank for a box, the box for receiving a plurality of containers containing a liquid, each container having a fitment, the blank comprising:

a top panel, the top panel including a plurality of apertures;

a first side panel hingedly coupled to the top panel;

a bottom panel hingedly coupled to the first side panel, the top panel and the bottom panel being located at opposite sides of the first side panel;

a second side panel hingedly coupled to the bottom panel, the first and second panels being located on opposite side of the bottom panel;

a third side panel including at least one third side panel flap hingedly coupled to an adjacent side of one of the first and second side panels; and, a fourth side panel including at least one fourth side panel flap hingedly coupled to an adjacent side of another one of the first and second side panels, when assembled, the top, bottom, first, second, third and fourth panels define an inner volume to receive the plurality of containers, each aperture of the top panel being associated with the fitment of a respective container and configured to allow the respective fitment to be positioned outside of the inner volume, the first side panel including at least one first cutout, the second side panel including at least one second cutout, the at least one first cutout and the at least one second cutout forming an inner support panel, the inner support panel is located within the inner volume to separate the inner volume into a plurality of compartments, each compartment being configured to receive one of the plurality of containers, the first and second cutouts configured to be folded inward to form the inner support panel, wherein a pair of opposing slots are formed in the interior volume with the first and second cutouts folded inward; and, a separate inlay support panel configured to provide additional support to the inner support panel, the separate inlay support panel including a main support panel, two wing panels located on opposite side of the main support panel, and opposing tabs, each of the opposing tabs being positioned within a respective one of the opposing slots, each of the two wing panels being positioned against an inner wall of the box to assist in positioning of the main support panel.

14. An assembly, comprising:

an outer box; and, an inner box within the outer box, the inner box, including:

a top panel, the top panel including a plurality of apertures;

a bottom panel;

first, second, third and fourth side panels, the top, bottom, first, second, third and fourth panels connected together defining an inner volume and, an inner support panel located within the inner volume to separate the inner volume into a plurality of compartments, the top panel of the inner box and the outer box defining a fitment volume outside of the inner box between the top panel and the outer box; and, a plurality of containers, each container having a fitment, each compartment being configured to receive one of the plurality of containers wherein the respective fitment is positioned through a respective aperture in the top panel and located outside of the inner box within the fitment volume, the inner support panel being formed from a first cutout of one of the first, second, third and fourth panels and a second cutout of another one of the first, second, third and fourth panels, the first and second cutouts being folded inward to form the inner support panel, wherein a pair of opposing slots are formed in the interior volume with the first and second cutouts folded inward, the assembly further comprising a separate inlay support panel configured to provide additional support to the inner support panel, the separate inlay support panel including a main support panel, two wing panels located on opposite side of the main support panel, and opposing tabs, each of the opposing tabs being positioned within a respective one of the opposing slots, each of the two wing panels being positioned against an inner wall of the box to assist in positioning of the main support panel.

* * * * *